US006186309B1

(12) United States Patent
Tomioka

(10) Patent No.: US 6,186,309 B1
(45) Date of Patent: Feb. 13, 2001

(54) COIN DISCRIMINATING DEVICE

(75) Inventor: Akira Tomioka, Tokyo (JP)

(73) Assignee: Tomy Company, Ltd., Tokyo (JP)

( * ) Notice: Under 35 U.S.C. 154(b), the term of this patent shall be extended for 0 days.

(21) Appl. No.: 09/245,216

(22) Filed: Feb. 5, 1999

(30) Foreign Application Priority Data

Aug. 28, 1998 (JP) ..... 10-243817

(51) Int. Cl.[7] ..... G07F 5/04
(52) U.S. Cl. ..... 194/236; 194/255
(58) Field of Search ..... 194/236, 237, 194/255, 292, 335

(56) References Cited

U.S. PATENT DOCUMENTS 2,684,143 * 7/1954 Obodzinski ..... 194/255
5,070,986 * 12/1991 Hoffman et al. ..... 194/237
5,715,924 2/1998 Tomioka ..... 194/237

FOREIGN PATENT DOCUMENTS

155369 * 2/1954 (AU) ..... 194/236

* cited by examiner

*Primary Examiner*—F. J. Bartuska
(74) *Attorney, Agent, or Firm*—Nixon & Vanderhye P.C.

(57) ABSTRACT

A coin discriminating device for discriminating put-in coins into a normal coin and a smaller coin, in which the maximum number of normal coins to be put-in can be easily changed. The coin discriminating device includes a turn plate having a cut-out portion and a coin discriminating pawl portion on a periphery thereof. A plurality of coin discriminating levers, each of which has an engaging portion able to engage with the coin discriminating pawl portion, abut against a periphery of corresponding received put-in coins in the cut-out portion, respectively. A biasing member biases a free end of the coin discriminating levers to a side of the turn plate, and a handle is provided for rotating the turn plate. A regulating member regulates a number of normal coins to be put in the cut-out portion of the turn plate, and a setting member is provided for setting the number of normal coins to be put-in. A clearing member is provided for clearing an engaging portion of an unnecessary coin discriminating lever out of a region to engage with the coin discriminating pawl portion.

23 Claims, 23 Drawing Sheets

COIN DISCRIMINATING DEVICE

BACKGROUND OF THE INVENTION

1. Field of the Invention

The present invention relates to a coin discriminating device incorporated in, for example, an automatic vending machine for selling commodities, and the like; and to an automatic vending machine containing the coin discriminating device.

2. Earlier Development

A portion of an automatic vending machine according to an earlier development is shown in FIG. 20. Such automatic vending machines 90 are arranged in amusement houses, the landings of staircases in the department stores and the like. In an automatic vending machine 90, when a buyer puts in one or two normal coins (for example, one-dollar coin, 100-yen coin or the like) and turns a handle 91, a commodity is discharged at a commodity take-out port 92. The automatic vending machine 90 is provided with a coin discriminating device for discriminating whether the put-in coin is the normal coin or a coin smaller than the normal coin.

Such a coin discriminating device and an automatic vending machine containing such a device are disclosed in U.S. Pat. No. 5,715,925 which is based on the application by the same inventor. The coin discriminating device comprises: a turn plate having a cut-out portion in the periphery, which can receive double-layered put-in coins in a direction parallel to the axis of rotation; two coin discriminating levers provided in a state double-layered in the direction parallel to the axis of rotation so as to be operable independently; a spring for biasing the free ends of the coin discriminating levers to abut the turn plate independently; a handle for rotating the turn plate by force, and a passage regulating member for going in the cut-out portion of the turn plate at the initial position to regulate the number of normal coins which can be put into the cut-out portion.

In order to change the number of normal coins which can be put-in, from 2 to 1, in such a coin discriminating device, while the two coin discriminating levers are united as a body by a first setting member for setting the number of coins to be put in, the entirety of or a part of the regulating member for regulating the number of normal coins to be put in the cut-out portion is entered into the cut-out portion of the turn plate by operating the regulating member by a second setting member for setting the number of coins to be put in. On the contrary, in order to change the number of normal coins which can be put-in, from 1 to 2, while unification of the two coin discriminating levers are released by the first setting member, the entirety of or a part of the regulating member is taken out of the cut-out portion of the turn plate by operating the regulating member by the second setting member.

Such a coin discriminating device has a problem that the structure and the operation for controlling two coin discriminating levers are complicated. Further, there is a problem that two operations of the setting members are required in order to change the number of normal coins which can be put-in.

SUMMARY OF THE INVENTION

The present invention has been made for solving such problems.

Therefore, an object of the present invention is to provide a coin discriminating device in which the structure and the operation for controlling coin discriminating levers are simple.

Another object of the present invention is to provide a coin discriminating device which can easily change the number of normal coins to be put-in.

A further object of the present invention is to provide an automatic vending machine including such a coin discriminating device, which has a simple structure and can easily change the number of normal coins to be put-in.

In accordance with one aspect of the present invention, a coin discriminating device for discriminating put-in coins into a normal coin and a coin smaller than the normal coin includes:

a turn plate having a cut-out portion which can receive a plurality of layered put-in coins and having a coin discriminating pawl portion on a periphery thereof. A plurality of coin discriminating levers, each of which has an engaging portion engageable with the coin discriminating pawl portion of the turn plate and which are provided near the turn plate and are swingable around an axis independently of one another, abut against the corresponding received put-in coins in the cut-out portion, respectively, so that when a coin smaller than the normal coin is placed in the cut-out portion, the engaging portion of the coin discriminating lever runs against the coin discriminating pawl portion of the turn plate by rotation thereof to prevent the rotation of the turn plate. When a normal coin is placed in the cut-out portion, the coin discriminating lever is pushed by the normal coin in the cut-out portion to clear the engaging portion of the coin discriminating lever from engagement with the coin discriminating pawl portion of the turn plate. A biasing member biases a free end of each coin discriminating lever to a side of the turn plate, a handle is provided for rotating the turn plate. A regulating member is provided for regulating a number of normal coins to be put-in the cut-out portion of the turn plate by going in or out of the cut-out portion which is at an initial position thereof, and a setting member is provided for setting the number of normal coins to be put-in to make the regulating member go in or out of the cut-out portion by a predetermined depth corresponding to the number of normal coins set by the setting member. A clearing member clears the engaging portion of an unnecessary coin discriminating lever out of a region to engage with the coin discriminating pawl portion of the turn plate.

According to such a coin discriminating device, because the clearing member for is used to change the number of normal coins which can be put-in, it is possible to change the number of normal coins to be put-in effectively and to make the mechanism therefor simple.

Preferably, the setting member doubles as the clearing member. The setting member may comprise a first cam for adjusting a depth of the regulating member going in the cut-out portion, and a second cam for clearing the unnecessary coin discriminating lever out of the region to engage with the coin discriminating pawl portion of the turn plate.

According to the coin discriminating device having such a structure, because the regulating member and the unnecessary coin discriminating lever are operated by using the first and second cams, it is possible to simplify the structure. In the coin discriminating device, when operating only the setting member, the regulating member goes in or out of the cut-out portion of the turn plate which is at an initial position thereof, by a predetermined depth corresponding to the number of normal coins set by the setting member to regulate the number of normal coins which can be put in the cut-out portion while an unnecessary coin discriminating lever is operated to clear the engaging portion thereof out of the region to engage with the coin discriminating pawl portion of the turn plate. Therefore, because only an operation of the setting member works on both the regulating member and the unnecessary coin discriminating lever, it is possible to easily change the number of normal coins to be put-in.

Preferably, the regulating member is adjusted by operating the setting member through a first cam. The first cam may comprise first and second pressing surfaces which are formed in stages on a surface of the first cam circumferentially, the first and second pressing surfaces pressing to keep the regulating member at first and second stage positions different from each other, with respect to the cut-out portion, respectively. The first cam may further comprise a third pressing surface which is formed in a stage on a surface of the first cam circumferentially, the third pressing surface pressing to keep the regulating member at third stage position different from those of the first and second pressing surfaces, with respect to cut-out portion.

According to the coin discriminating device having such a structure, because the regulating member is adjusted by operating the setting member through the first cam, it is possible to simplify the structure.

Preferably, the unnecessary coin discriminating lever is cleared by operating the setting member through a second cam. The second cam may comprise a first peripheral surface cam for clearing the engaging portion of one of the coin discriminating levers out of the region. The second cam may further comprise a second peripheral surface cam for clearing the engaging portions of two of the coin discriminating levers out of the region.

According to the coin discriminating device having such a structure, because the unnecessary coin discriminating lever is cleared by operating the setting member through a second cam, it is possible to simplify the structure.

In accordance with another aspect of the present invention, an automatic vending machine includes:

a coin discriminating device for discriminating put-in coins into a normal coin and a coin smaller than the normal coin. The coin discriminating device comprises; a turn plate having a cut-out portion which can receive a plurality of layered put-in coins and having a coin discriminating pawl portion on a periphery thereof. A plurality of coin discriminating levers each of which has an engaging portion engageable with the coin discriminating pawl portion of the turn plate and which are provided near the turn plate and are swingable around an axis independently of one another, abut against the corresponding received put-in coins in the cut-out portion, respectively, so that when a coin smaller than the normal coin is placed in the cut-out portion, the engaging portion of the coin discriminating lever runs against the coin discriminating pawl portion of the turn plate by rotation thereof to prevent the rotation of the turn plate. When a normal coin is placed in the cut-out portion, the coin discriminating lever is pushed by the normal coin in the cut-out portion to clear the engaging portion of the coin discriminating lever from engagement with the coin discriminating pawl portion of the turn plate. A biasing member biases a free end of each coin discriminating lever to a side of the turn plate, and a handle is provided for rotating the turn plate. A regulating member is provided for regulating a number of normal coins to be put in the cut-out portion of the turn plate by going in or out of the cut-out portion which is at an initial position thereof, and a setting member is provided for setting the number of normal coins to be put in the cut-out portion to make the regulating member go in or out of the cut-out portion by a predetermined depth corresponding to the number of normal coins set by the setting member. A clearing member clears the engaging portion of an unnecessary coin discriminating lever out of a region to engage with the coin discriminating pawl portion of the turn plate.

The automatic vending machine also includes a commodity discharging device having a drum rotatable with respect to a shaft extending in a vertical direction and which is provided with a commodity discharging opening penetrating in a vertical direction and is arranged to discharge a commodity through the commodity discharging opening by rotating the drum through a predetermined angle.

According to the automatic vending machine having such a structure, because only an operation of the setting member works on both the regulating member and the unnecessary coin discriminating lever, it is possible to change the number of normal coins to be put-in easily and to simplify the structure.

BRIEF DESCRIPTION OF THE DRAWINGS

The present invention will become more fully understood from the detailed description given hereinbelow and the accompanying drawings which are given by way of illustration only, and thus are not intended as a definition of the limits of the present invention, and wherein.

PREFERRED EMBODIMENT OF THE INVENTION

Figure 1:
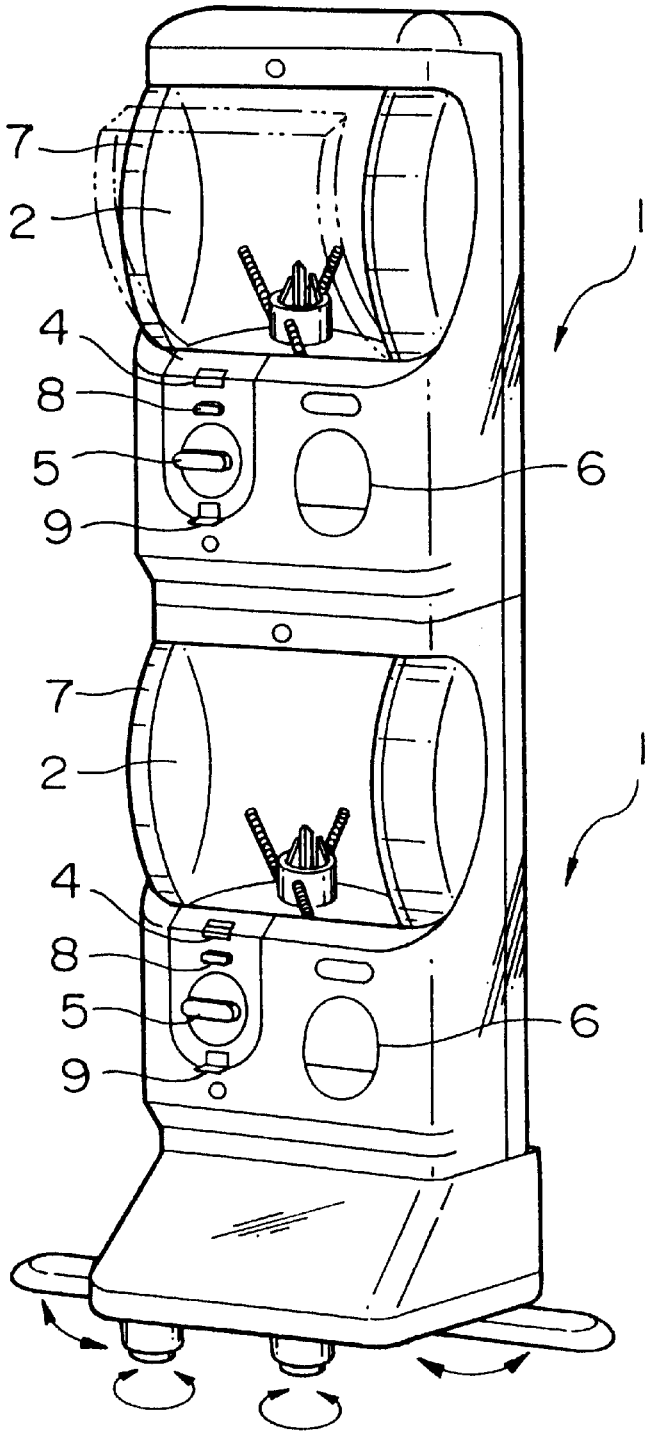
FIG. 1 is a perspective view of an automatic vending machine according to an embodiment of the invention.
Figure 2:
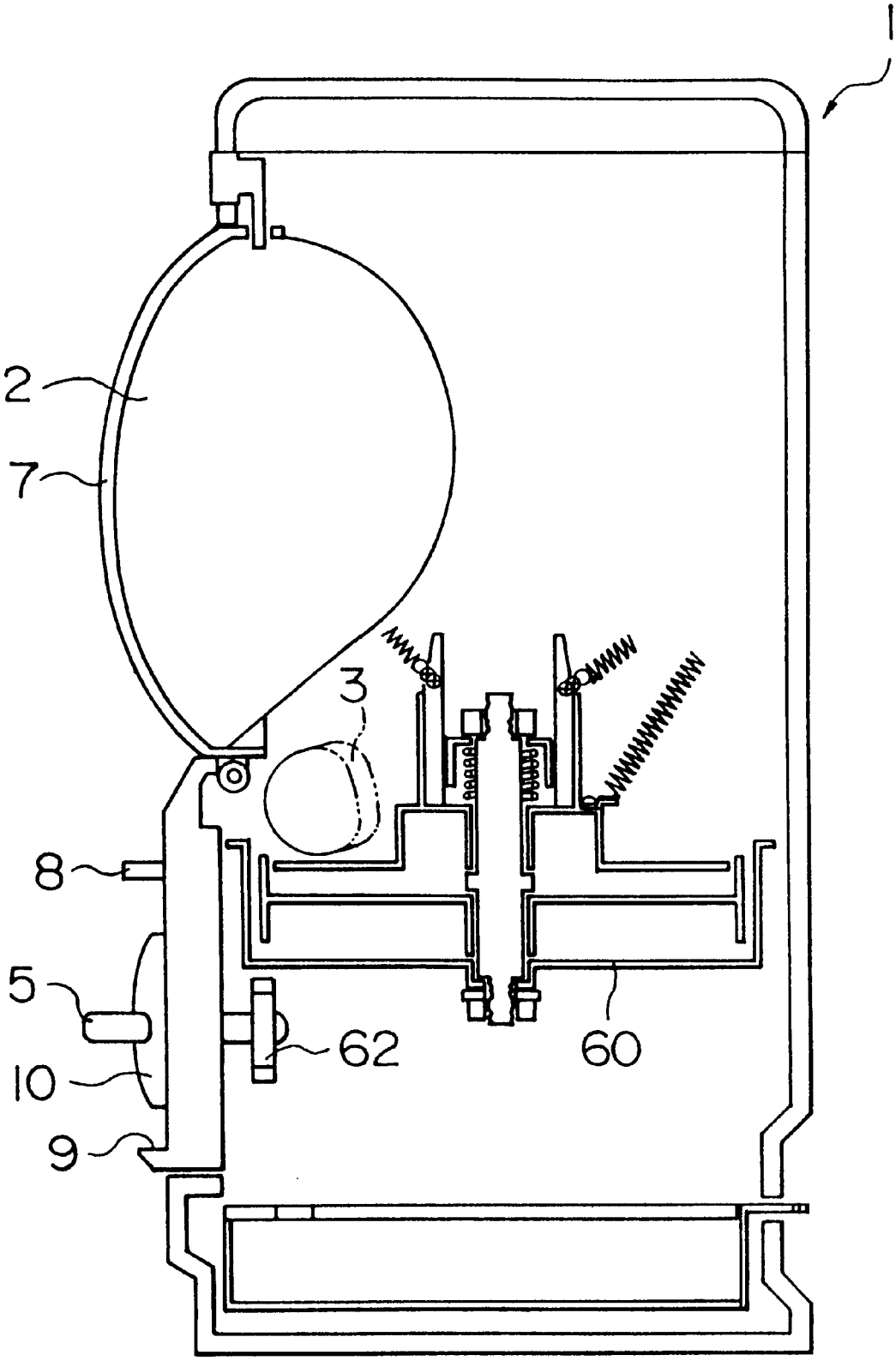
FIG. 2 is a vertical sectional view, seen from right side, of the automatic vending machine according to the embodiment.

FIG. 1 is a perspective view of double-layered automatic vending machines according to an embodiment of the invention. FIG. 2 is a perspective view, seen from right side, of the automatic vending machine according to the embodiment.

Figure 3:
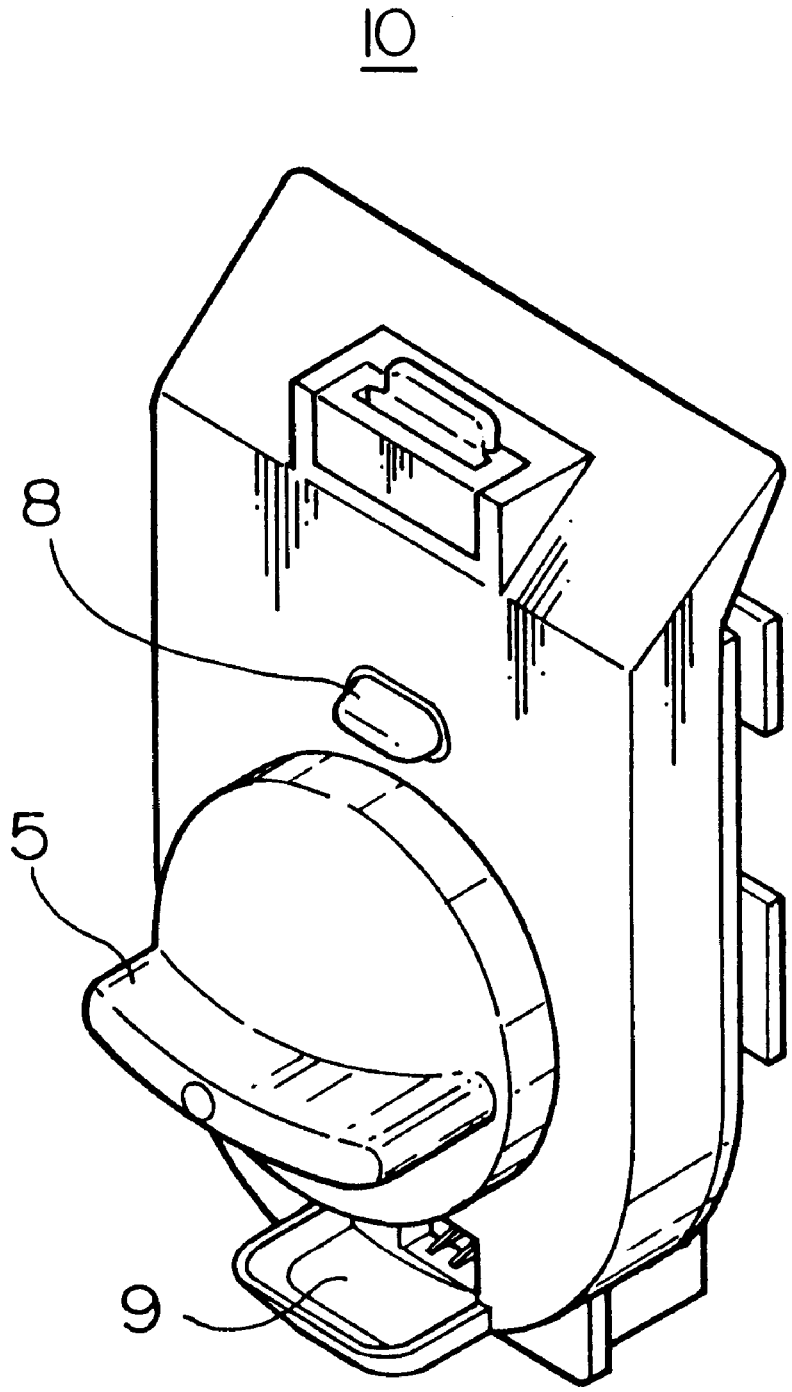
FIG. 3 is a perspective view, seen from front side, of a coin discriminating device of the automatic vending machine, according to an embodiment of the invention.

As shown in FIG. 2, the automatic vending machine 1 is provided with a coin discriminating device 10 shown in FIG. 3 and a commodity discharging device 60. In the automatic vending machine 1, capsule commodities 3 which are shown in FIG. 2, are filled in a commodity storage section 2. By putting a required number of given coins into a coin put-in slot 4 and turning a handle 5 in the clockwise direction, only one of the capsule commodities 3 comes out at a commodity take-out port 6. Further, in the automatic vending machine 1, filling of the capsule commodities 3 are achieved by opening a front cover 7 toward this side as shown by two-dot chain lines, as shown in FIG. 1. Further, in the automatic vending machine 1, by pushing a return button 8, a wrongly put-in coin or the like is returned at a return port 9.

Details of the structure of the coin discriminating device incorporated in the automatic vending machine 1 will be explained with reference to the drawings.

Figure 4:
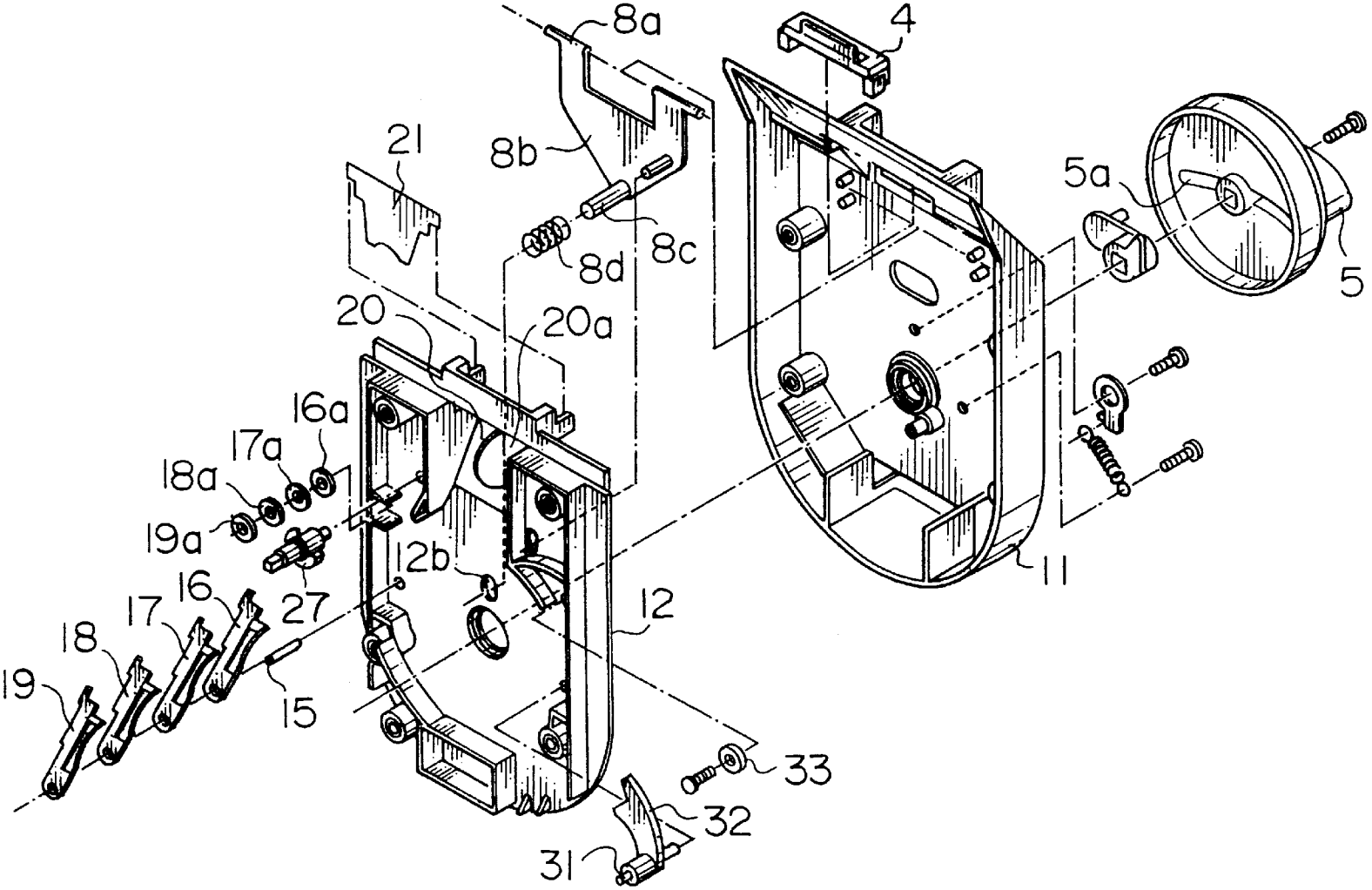
FIG. 4 is an exploded perspective view, seen from rear side, of a front half of the coin discriminating device of the embodiment.
Figure 5:
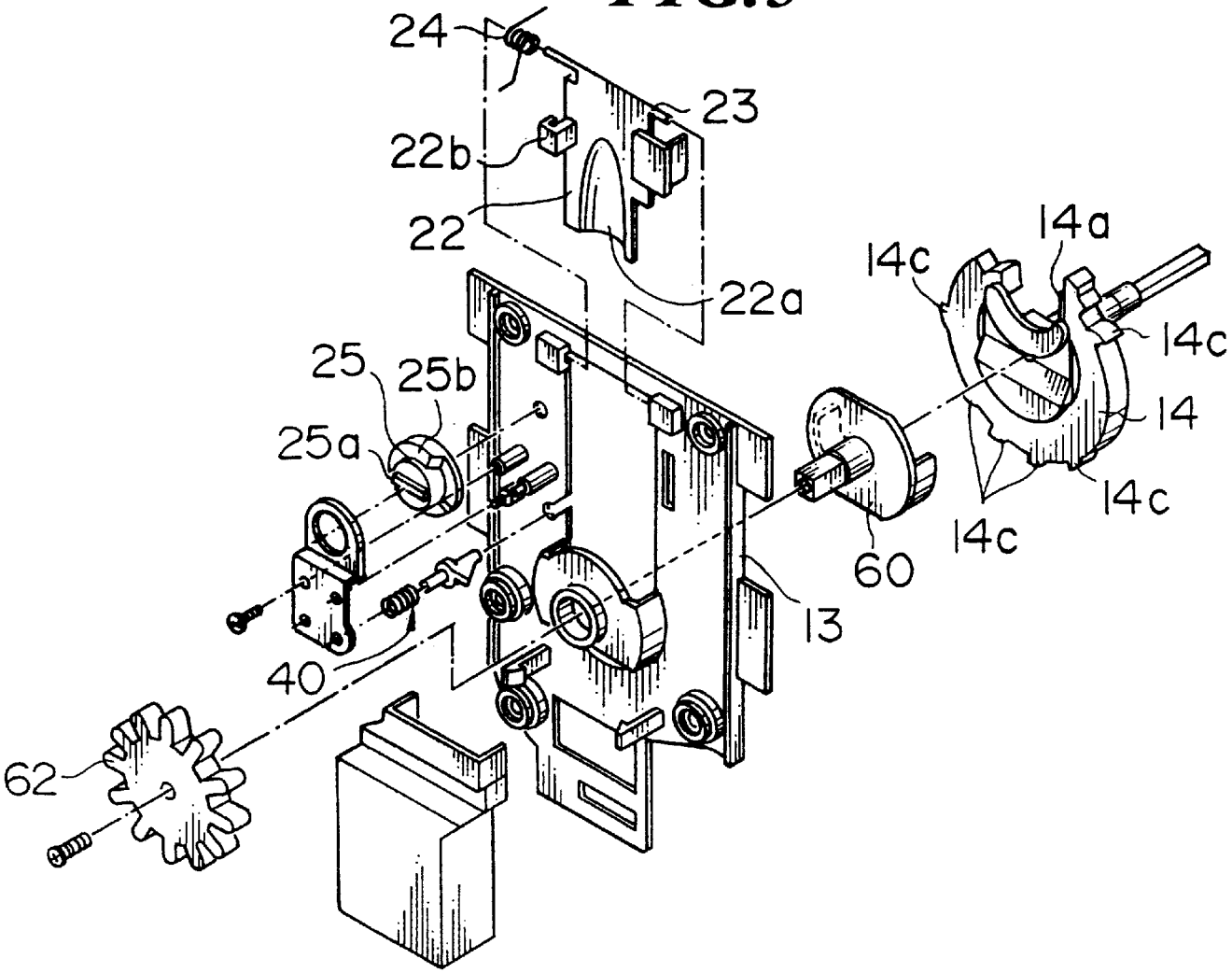
FIG. 5 is an exploded perspective view, seen from rear side, of a rear half of the coin discriminating device of the embodiment.
Figure 6:
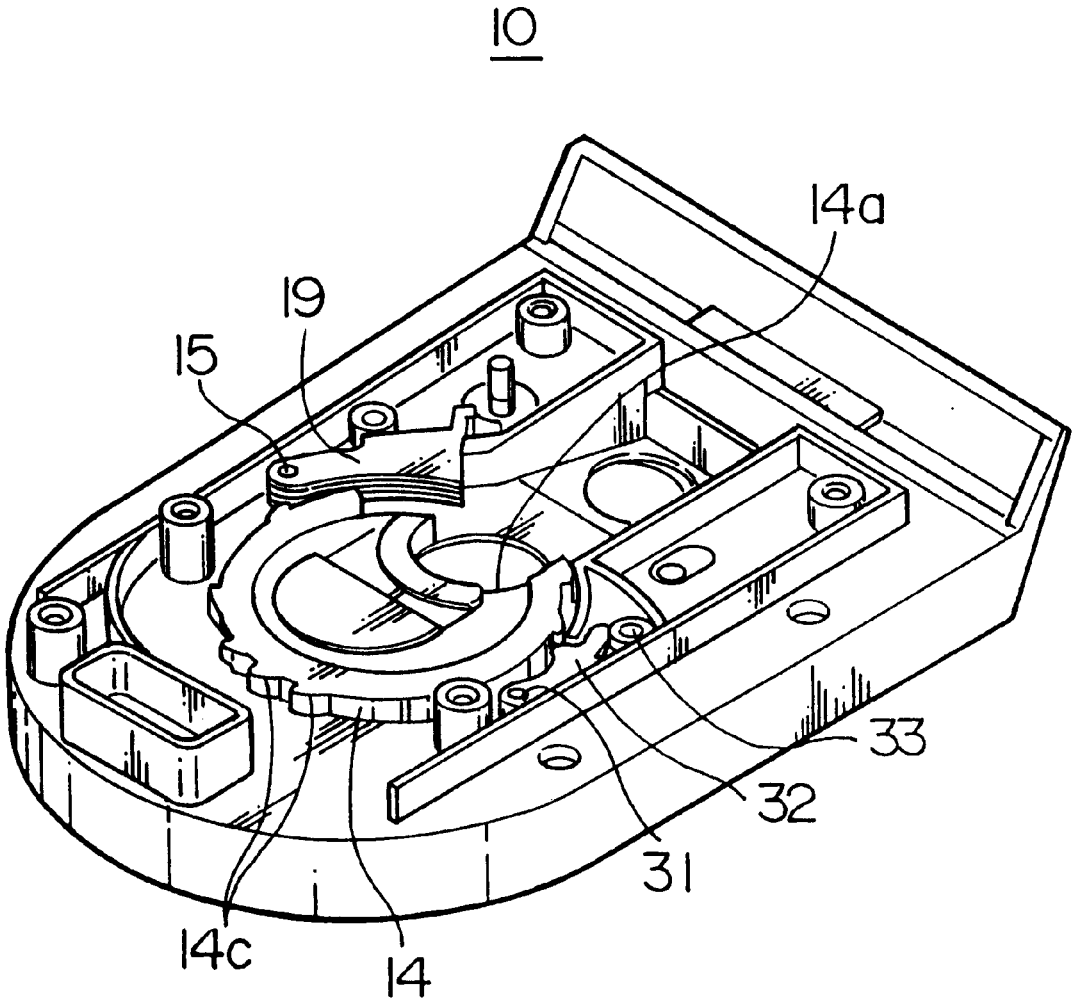
FIG. 6 is a perspective view, seen from rear side, of a state where an inner frame is removed from the coin discriminating device of the embodiment.

FIG. 3 is a perspective view, seen from front side, of the coin discriminating device of the automatic vending machine of the embodiment, FIG. 4 is an exploded perspective view, seen from rear side, of a front half of the coin discriminating device, FIG. 5 is an exploded perspective view, seen from rear side, of a rear half of the coin discriminating device of the embodiment, and FIG. 6 is a perspective view, seen from rear side, of a state where an inner frame is removed from the coin discriminating device of the embodiment.

In this embodiment, the coin discriminating device 10 is provided with an outer frame 11, a middle plate 12, an inner frame 13, wherein a turn plate 14 coupled to the handle 5 is provided between the middle plate 12 and the inner frame 13. The turn plate 14 turns with turning of the handle 5. As shown in FIGS. 5 and 6, the turn plate 14 is provided with a cut-out portion 14a which can receive one to four put-in coins layered in a standing attitude. In the vicinity of the turn plate 14, four coin discriminating levers 16, 17, 18, and 19 are provided to put on another so as to rock right and left about an axis (shaft 15). The coin discriminating levers 16, 17, 18, and 19 can rock right and left on the shaft 15 independently of one another. Each of the coin discriminating levers 16, 17, 18, and 19 is biased toward the turn plate 14 by means of a ring-shaped resilient member (biasing member) 16*a*, 17*a*, 18*a*, or 19*a* of silicone rubber. The coin discriminating levers 16, 17, 18, and 19 are arranged to abut against four layered put-in coins which are received in the cut-out portion 14*a* of the turning turn plate, respectively. For the biasing members 16*a*, 17*a*, 18*a*, and 19*a*, spring members of different material or different shape, e.g., four-forked resilient pieces of a plate spring, can be also used.

The function of the coin discriminating levers 16, 17, 18, and 19 having such a structure will be explained using the coin discriminating lever 16 as an example, as follows.

Figure 7:
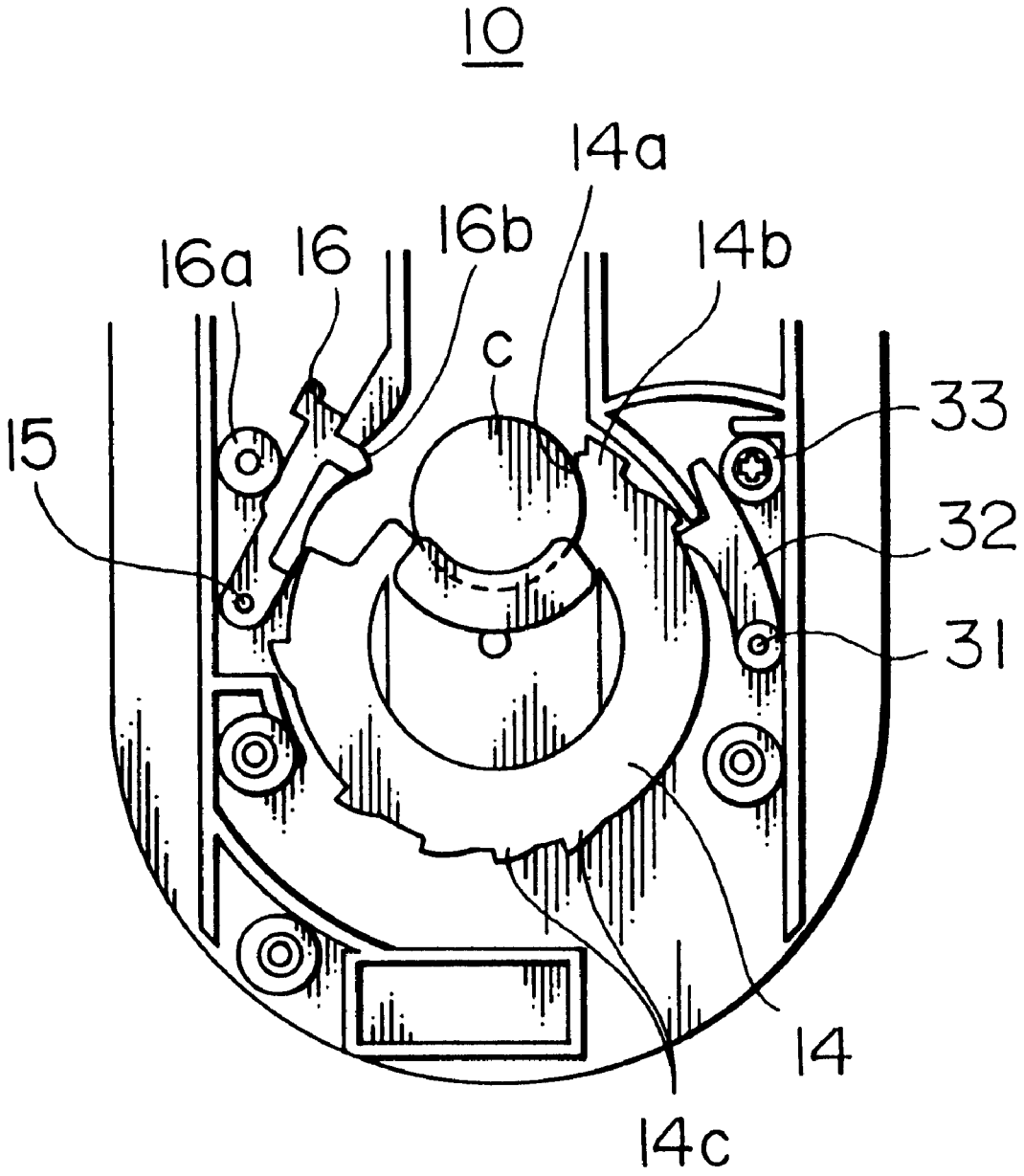
FIG. 7 is a view showing a state of a turn plate and the periphery thereof, of the coin discriminating device of the embodiment when a coin is put in the device.
Figure 8:
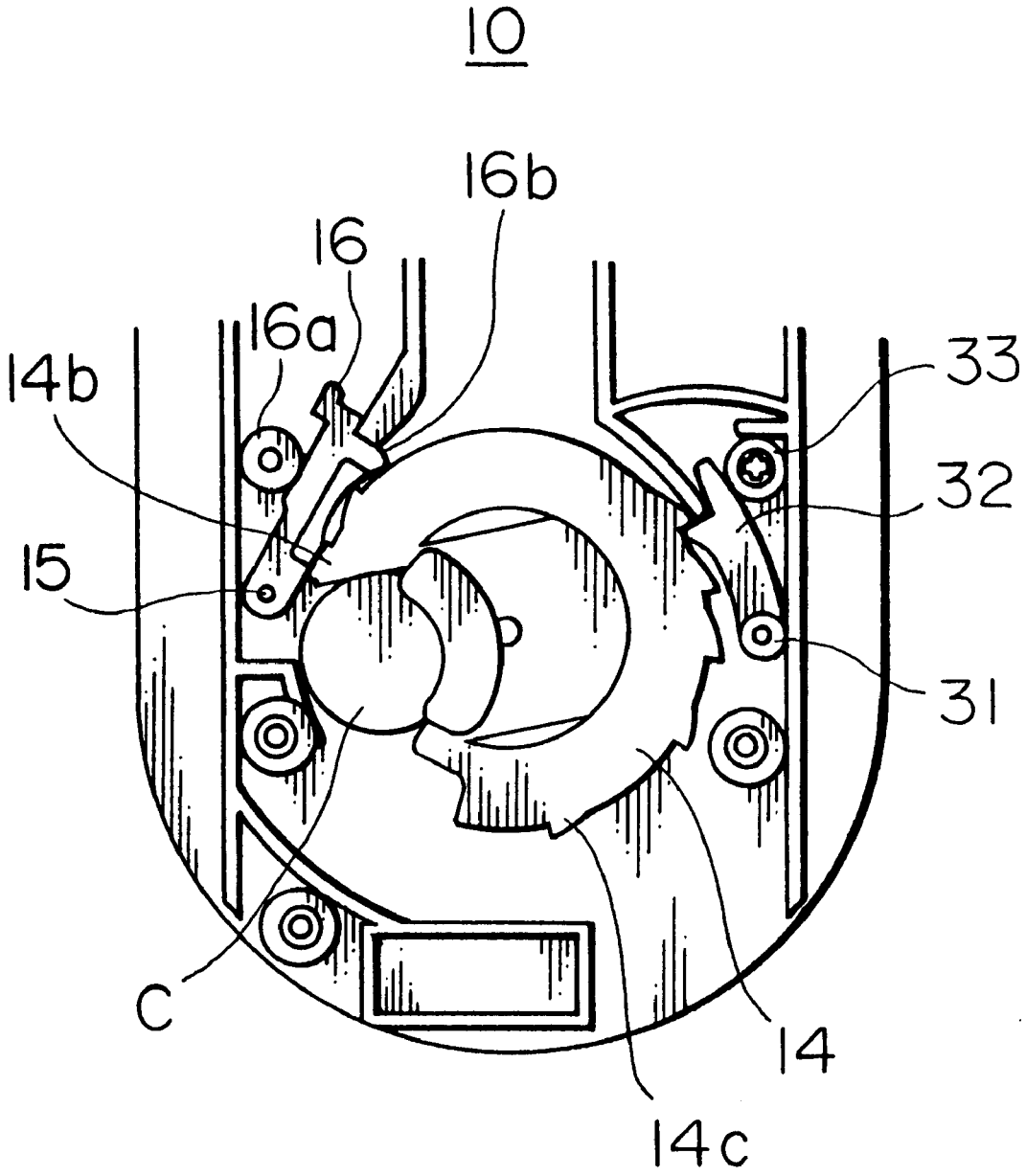
FIG. 8 is a view showing a state of a turn plate and the periphery thereof, of the coin discriminating device of the embodiment when a handle of the device is rotated.
Figure 9:
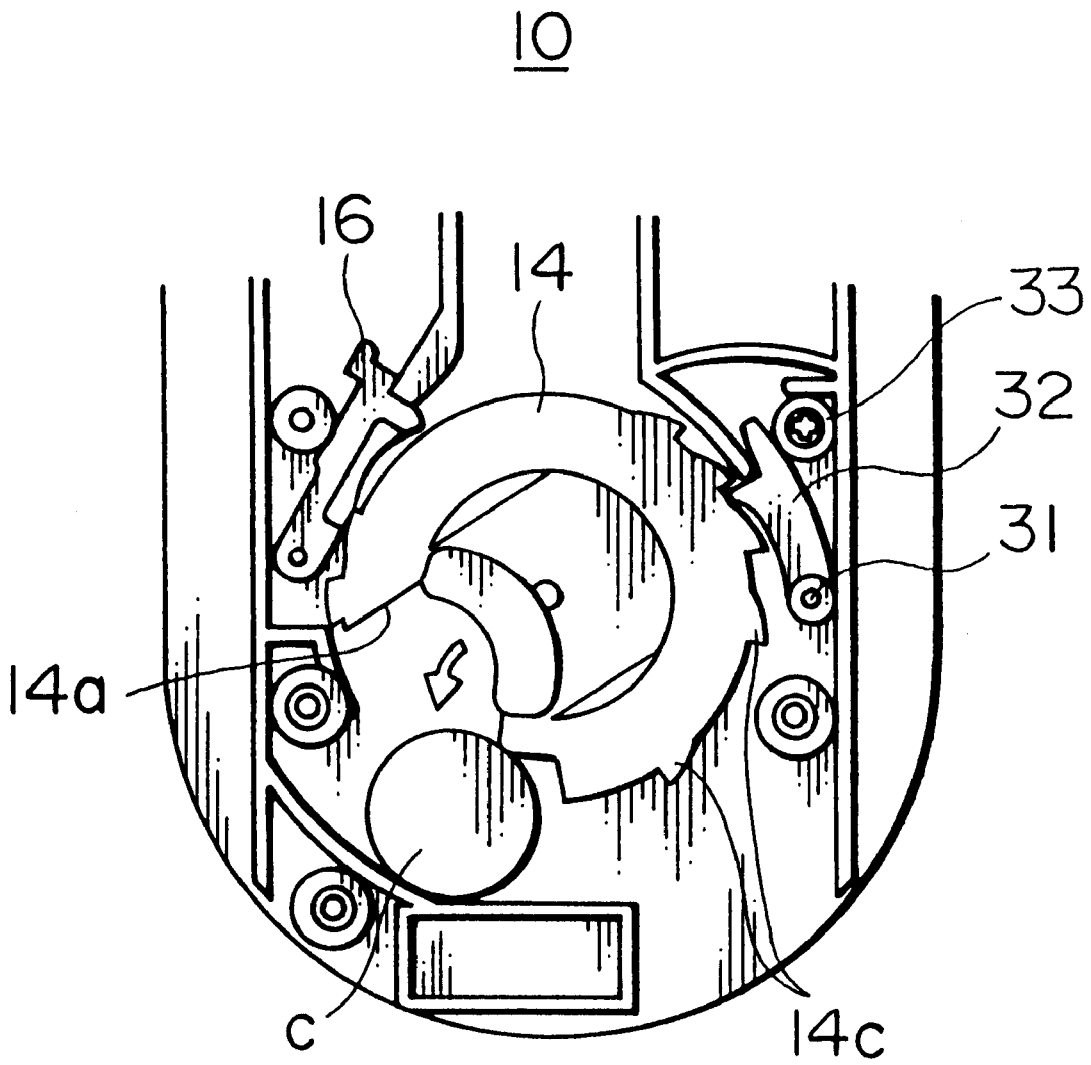
FIG. 9 is a view showing a state of a turn plate and the periphery thereof, of the coin discriminating device of the embodiment when a handle of the device is rotated.
Figure 10:
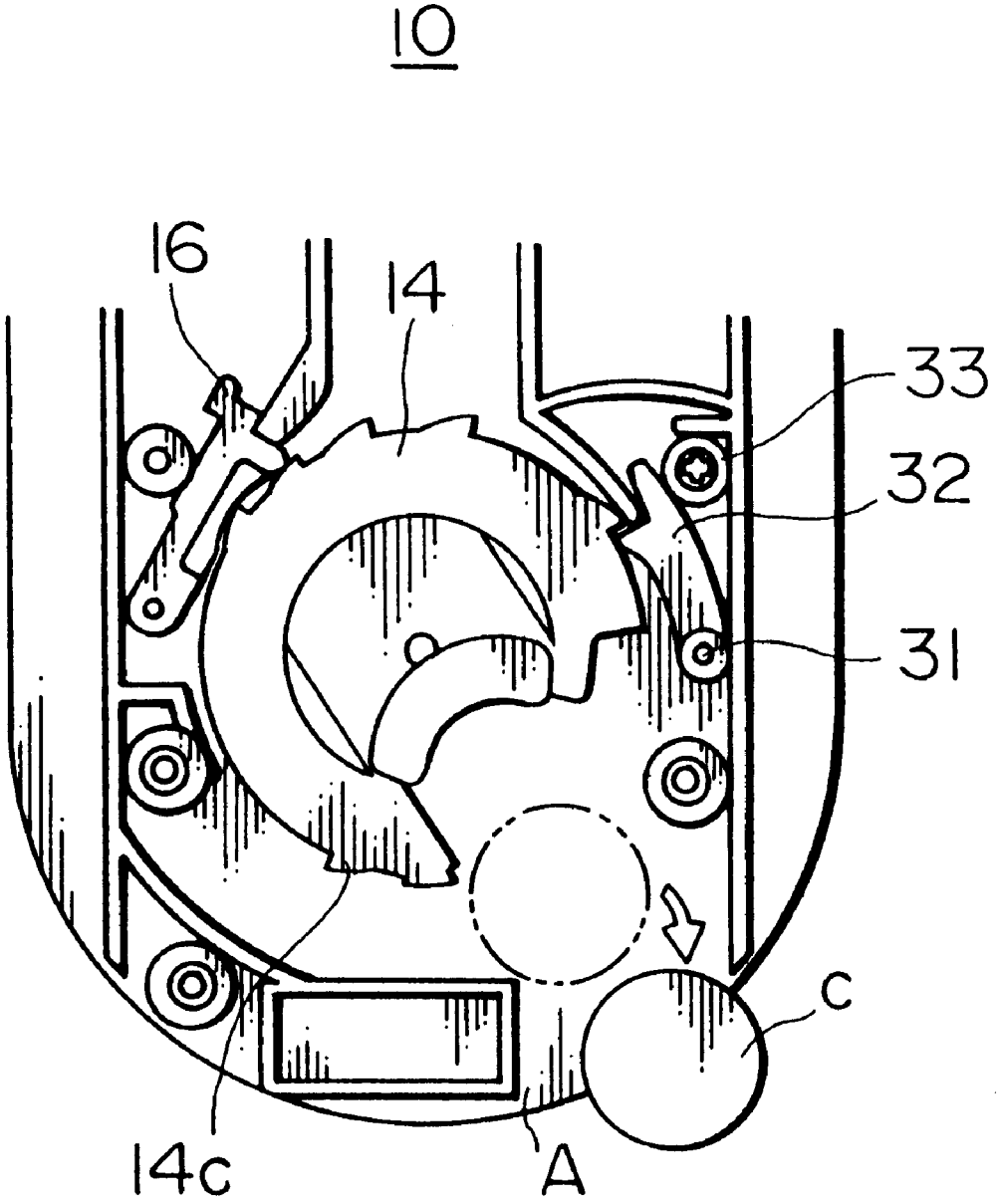
FIG. 10 is a view showing a state of a turn plate and the periphery thereof, of the coin discriminating device of the embodiment when a handle of the device is rotated.

As shown in FIG. 7, in case that a normal coin, e.g., 100-yen coin, "C" is placed in the cut-out portion 14*a* of the turn plate 14, when the handle 5 is turned to rotate the turn plate 14, a slidably-contacting intermediate portion (curved portion) of the coin discriminating lever 16 is pushed by the normal coin "C" so that the free end of the coin discriminating lever 16 is retreated relative to the turn plate 14. Thus, since the tip (engaging portion 16*b*) of the coin discriminating lever 16 does not abut an end portion (coin discriminating pawl portion 14*b*) of the cut-out portion 14*a* of the turn plate 14, the turn plate 14 is set in a state where rotation thereof is not prevented by the coin discriminating lever 16. As a result, the coin discriminating pawl portion 14*b* of the turn plate 14 can pass the engaging portion 16*b*, as shown in FIG. 8. Then, when the turn plate 14 turns further, as shown in FIG. 9, the coin "C" held in the cut-out portion 14*a* falls by its own weight out of the cut-out portion 14*a* to a passage "A" finally, as shown in FIG. 10, so as to be stored in a non-shown container. When a coin which is smaller than the normal coin "C" is placed in the cut-out portion 14*a* of the turn plate 14, since the intermediate portion of the coin discriminating lever 16 is not pushed by the smaller coin, the coin discriminating lever 16 is not retreated from the turn plate 14. As a result, the engaging portion 16*b* of the coin discriminating lever 16 runs against the coin discriminating pawl portion 14*b* of the turn plate 14 by rotation of the turn plate 14, so that rotation of the turn plate 14 is prevented. Thus, discrimination between a normal coin "C" and a smaller coin can be carried out. Since the operation of the coin discriminating lever 17, 18 or 19 is the same as that of the coin discriminating lever 16, detailed explanation therefor is omitted. In case of a capsule commodity 3 which requires 2–4 normal coins "C" , since the 2–4 coins are put in the cut-out portion 14*a* in a layered state, truth or falsehood of each coin can be ascertained by means of the respective coin discriminating levers 16, 17, 18, or 19. When at least one of the 2–4 coins is smaller than a normal coin, at least one of the engaging portions 16*b*, 17*b*, 18*b*, and 19*b* of the coin discriminating levers 16, 17, 18, and 19 runs against the coin discriminating pawl portion 14*b* of the turn plate 14 by rotation of the turn plate 14, so that rotation of the turn plate 14 is prevented.

As described above, discrimination between a normal coin "C" and a smaller coin is thus performed by the coin discriminating levers 16, 17, 18 and 19. On the other hand, discrimination between the normal coin "C" and a larger coin is performed, in this embodiment, by setting a width of the coin put-in slot 4 to be slightly larger than (substantially equal to) the diameter of the normal coin "C".

Figure 11:
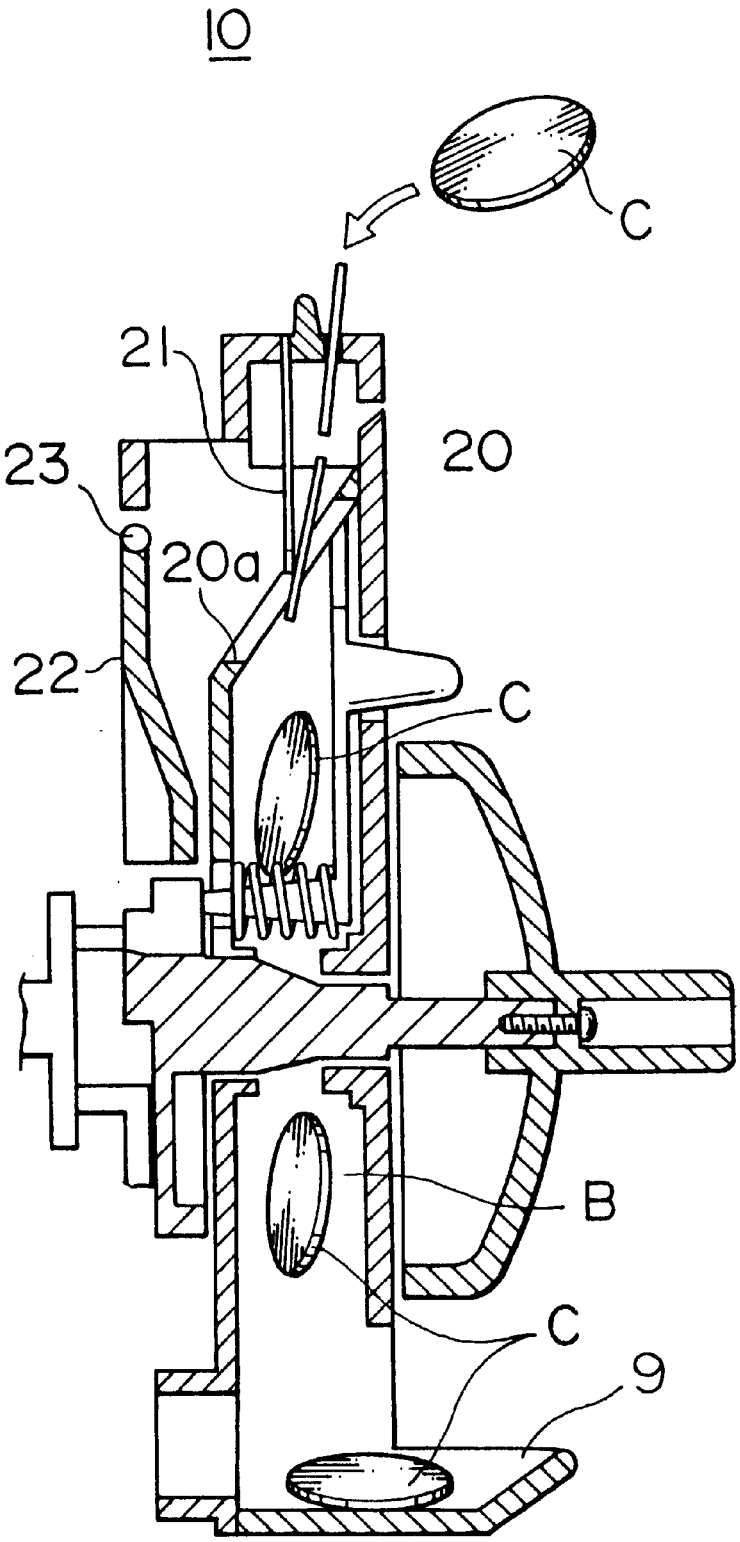
FIG. 11 is a view for explaining a function of the coin discriminating device of the embodiment when an extremely small coin is put in the device.

Discrimination between a normal coin and a very small coin is performed by providing a slope 20 for coin discrimination under the coin put-in slot 4, as shown in FIG. 11. In the slope 20 for coin discrimination, an opening 20*a* for coin discrimination which is smaller than the normal coin, is formed. At an inner position just behind the coin put-in slot 4, a film 21 is hanging down toward the opening 20*a* for coin discrimination. The film 21 is for introducing a put-in coin into the opening 20*a* surely. A coin which is much smaller than the normal coin "C" is dropped to a passage "B" through the opening 20*a* and is sent to a coin return port 9. A normal coin "C" and a slightly smaller coin pass under the film 21 with sliding on the slope 20 for coin discrimination, to enter the cut-out portion 14*a* of the turn plate 14.

Figure 12:
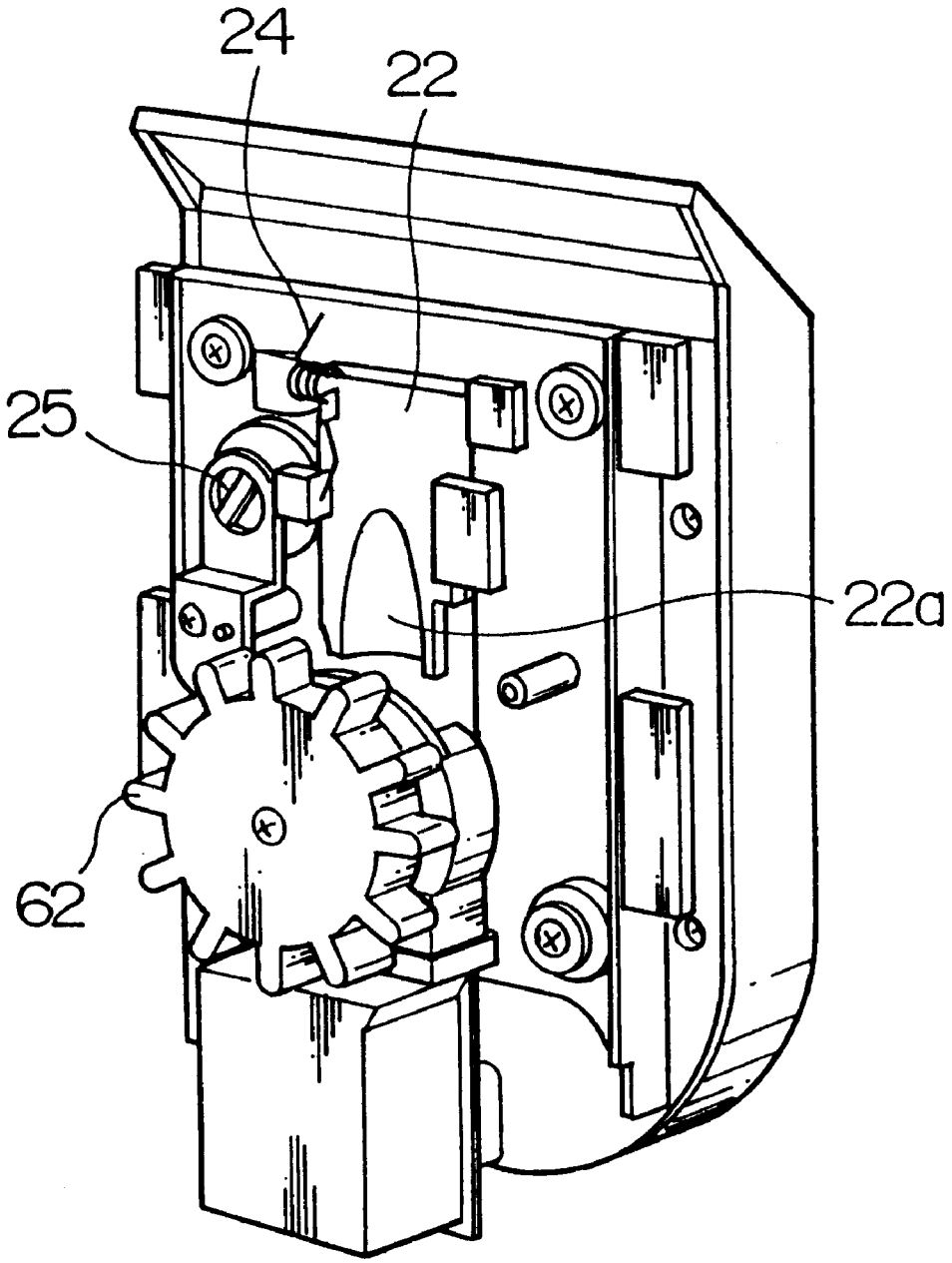
FIG. 12 is a perspective view, seen from rear side, of the coin discriminating device of the automatic vending machine, according to the embodiment.

A regulating member 22 for regulating the number of normal coins which can be put in the cut-out portion 14*a* of the turn plate 14, is provided on the inner frame 13, as shown in FIGS. 5 and 12. The regulating member 22 for regulating the number of coins to be put-in can swing around a shaft 23 extending in a lateral direction. A portion of the regulating member 22, i.e., curved portion 22*a*, which projects into the side of turn plate 14, can go in and out of the cut-out portion 14*a* of the turn plate 14 by its swinging. By changing the degree of the regulating member 22 going in the cut-out portion 14*a*, it is possible to regulate the number of normal coins to be put in the cut-out portion 14*a*. A torsion coil spring 24 is hung on the shaft 23 of the regulating member 22 to bias the regulating member 22 to the side of the turn plate 14.

Figure 13:
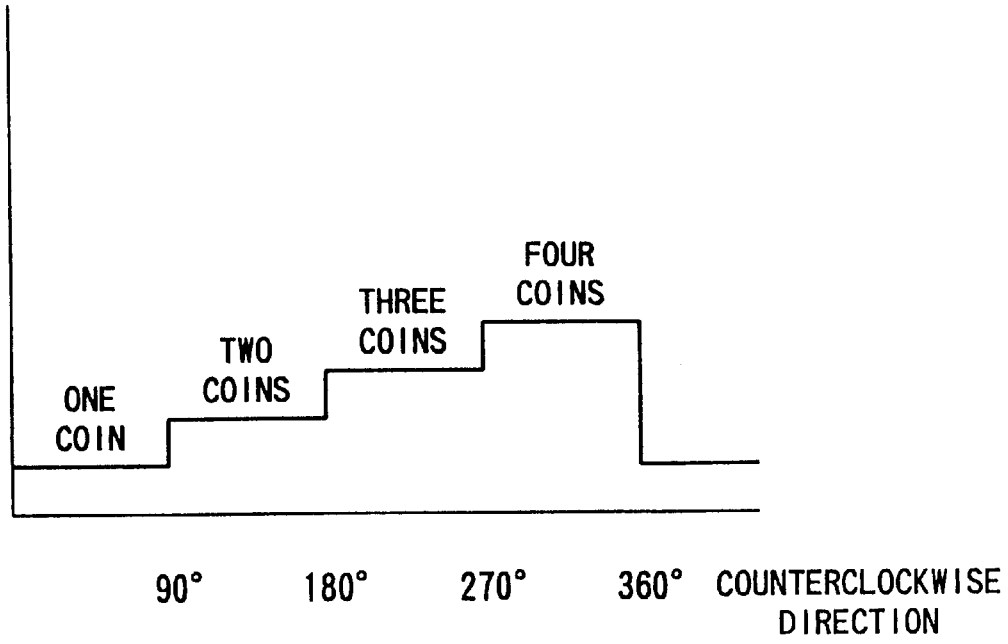
FIG. 13 is a cam diagram of an end cam (the first cam) of the coin discriminating device of the embodiment.

Adjacent the regulating member 22 for regulating the number of coins to be put-in, a disc-shaped setting member 25 is provided for setting the number of coins to be put-in, which is rotatable around the central axis thereof, as shown in FIGS. 5 and 12. The setting member 25 comprises a disc-shaped body 25*b* and a disc-shaped central control 25*a* with a smaller diameter, which is coaxially and integrally formed on a surface of the body 25*b*. At the top surface of the central control 25*a*, a rod-shaped finger pinch is formed for rotating the setting member 25 by fingers. Around the central control 25*a* on the surface of the body 25*b*, a first cam comprising four steps is formed, as shown in FIG. 5. The peripheral four steps of the first end cam have thicknesses different from one another in the direction of the central axis. The surface in the side of the cut-out portion 14*a*, of a hook-shaped portion 22*b* which is formed on the surface in the setting member side of the regulating member 22 is brought into contact with and is pushed by one of the peripheral four steps of the first cam of the body 25*b*. A cam diagram of the first cam of the setting member 25 is shown in FIG. 13. Even when the maximum number of normal coins which can be put-in is four, it is not necessarily required to provide four steps to be brought into contact with and pushed against the regulating member 22, on the first cam of the body 25*b*. For example, when the number of normal coins which can be put-in is one, regulation of the degree of the regulating member 22 going in the cut-out portion 14*a* can be also carried out by bringing the regulating member 22 into contact with a fixed portion, e.g., formed on the middle plate 12 or the like.

The hook-shaped portion 22*b* provided at a side portion of the regulating member 22, which is biased toward the side of the cut-out portion 14*a* by the torsion spring 24, can be brought into contact with one of the four steps of the first cam of the body 25*b*. The regulating member 22 functions as a follower for the first cam. By rotating the control 25*a* of the setting member 25, the step to bring into contact with and to push the hook-shaped portion 22*b* can be changed by stages according to the rotation angle of the control 25*a*. That is, when the control 25*a* of the setting member 25 indicates one coin, the hook-shaped portion 22*b* of the regulating member 22 is brought into contact with and pushed by the thinnest first step of the first cam of the body 25*b*, so that the curved portion 22*a* of the regulating member 22 enters the cut-out portion 14*a* of the turn plate 14 deeply to admit only one normal coin into the space between the curved portion 22*a* and the middle plate 12. When rotating the control 25*a* to indicate two coins, the hook-shaped portion 22*b* is brought into contact with and pushed by the thicker second step of the first cam, so that the regulating member 22 rotates to broaden the space between the curved portion 22*a* and the middle plate 12 slightly, and thereby two layered normal coins are admitted into the space. When rotating the control 25*a* to indicate three coins, the hook-shaped portion 22*b* is brought into contact with and pushed by the further thicker third step of the first cam, so that the regulating member 22 rotates to broaden the space between the curved portion 22*a* and the middle plate 12, and thereby three layered normal coins are admitted into the space. Further, when rotating the control 25*a* to indicate four coins, the hook-shaped portion 22*b* is brought into contact with and pushed by the thickest fourth step of the first cam, so that the regulating member 22 rotates to further broaden the space between the curved portion 22*a* and the middle plate 12, and thereby four layered normal coins are admitted into the space. Thus, the extent to which the regulating member 22 is pushed up by the first cam of the setting member body 25*b*, that is, the extent to which the regulating member 22 goes in the cut-out portion 14*a*, can be changed, so that it is possible to change the maximum number of normal coins which can be put-in the cut-out portion 14*a* of the turn plate 14 which is at the initial position.

Figure 14A:
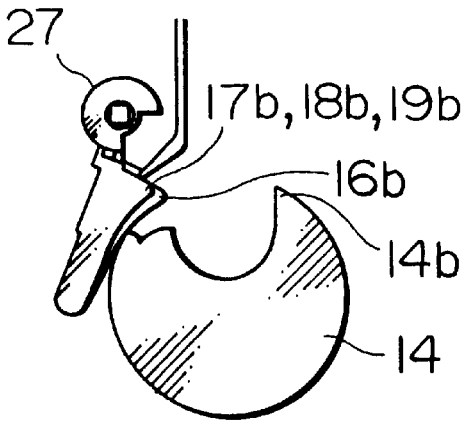
FIGS. 14A, 14B, 14C, and 14D are views for explaining the relationship among the second cam, the coin discriminating levers, and the coin discriminating pawl portion of the turn plate of the coin discriminating device of the embodiment.
Figure 14C:
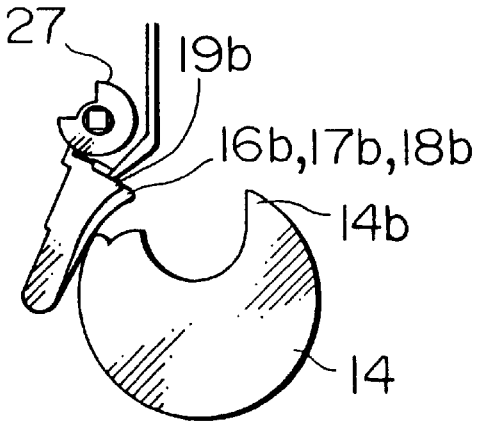
Figure 14B:
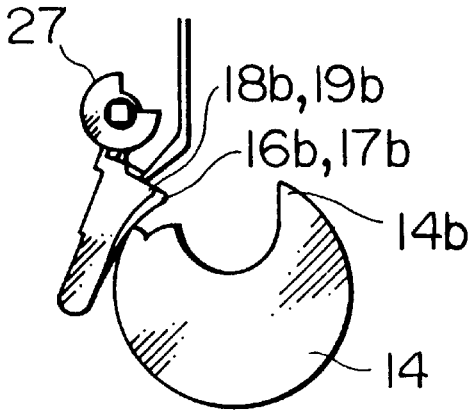
Figure 14D:
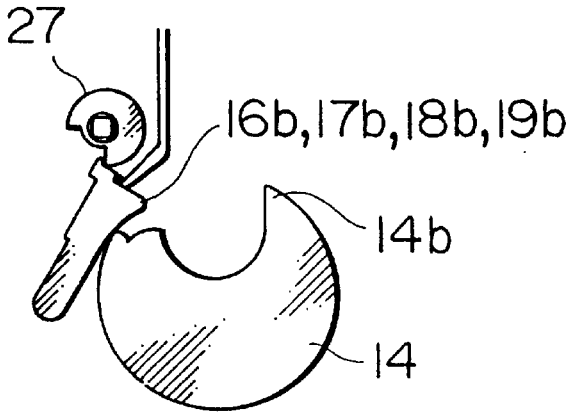
Figure 15A:
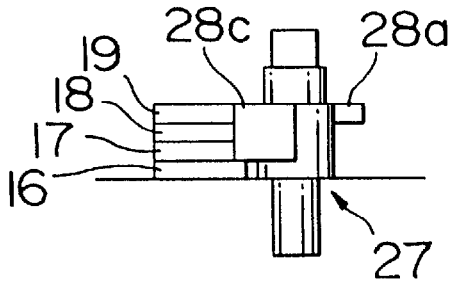
FIGS. 15A, 15B, 15C, and 15D are views for explaining the function of the first, second and third peripheral surface cams of the second cam.
Figure 15C:
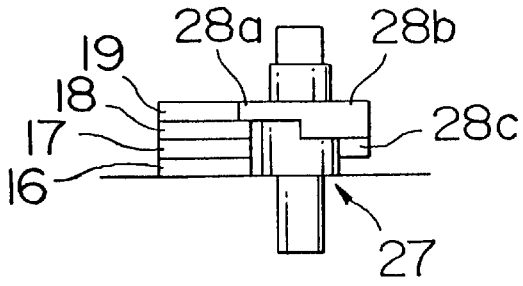
Figure 15B:
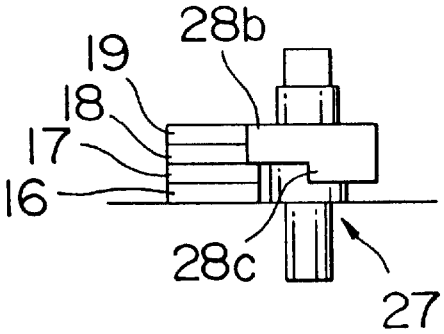
Figure 15D:
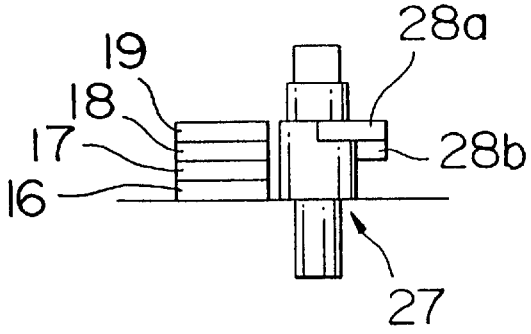

A clearing or, a rotary member 27 is concentrically connected to the setting member 25, as shown in FIG. 4. Therefore, rotation of the setting member 25 brings rotation of the rotary member 27. The rotary member 27 has a second cam formed on the peripheral surface thereof. The second cam comprises first, second and third peripheral surface cams 28*a*, 28*b* and 28*c* which are formed as a body and have approximately the same diameter and different thickness to one another. The first peripheral surface cam 28*a* has approximately the same thickness as a piece of the coin discriminating lever 16, 17, 18 or 19 and can engage with only the coin discriminating lever 19, as shown in FIGS. 14C and 15C when the control 25*a* of the setting member 25 indicates three coins. The second peripheral surface cam 28*b* has approximately the same thickness as two pieces of the coin discriminating levers and can engage with both the coin discriminating levers 18 and 19, as shown in FIGS. 14B and 15B when the control 25*a* of the setting member 25 indicates two coins. The third peripheral surface cam 28*c* has approximately the same thickness as three pieces of the coin discriminating levers and can engage with three coin discriminating levers 17, 18 and 19, as shown in FIGS. 14A and 15A when the control 25*a* of the setting member 25 indicates one coin. When the control 25*a* of the setting member 25 indicates four coins, no peripheral surface cam engages with the coin discriminating lever 16, 17, 18 or 19, as shown in FIGS. 14D and 15D.

While the coin discriminating lever 17, 18 or 19 engages with the first, second or third peripheral surface cam 28*a*, 28*b* or 28*c*, that is, while the lever is pushed by the surface cam 28*a*, 28*b* or 28*c* against the biasing force of the ring-shaped resilient member 17*a*, 18*a*, or 19*a*, the engagement portion 17*b*, 18*b* or 19*b* of the lever 17, 18 or 19 is cleared out of a region to engage with the coin discriminating pawl portion 14*b* of the turn plate 14.

That is, when optionally setting the number of normal coins to be put-in by rotating the control 25*a* of the setting member 25, it is possible not only to make the regulating member 22 go in or out of the cut-out portion 14*a* by a predetermined depth corresponding to the number of normal coins, but also to clear the engagement portion 17*b*, 18*b* or 19*b* of an unnecessary coin discriminating lever 17, 18 or 19 out of the region to engage with the coin discriminating pawl portion 14*b* of the turn plate 14.

Figure 16A:
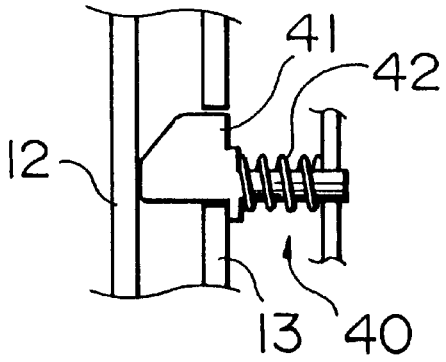
FIGS. 16A to 16C are views for explaining a function of a coin pushing member of the coin discriminating device of the embodiment.
Figure 16B:
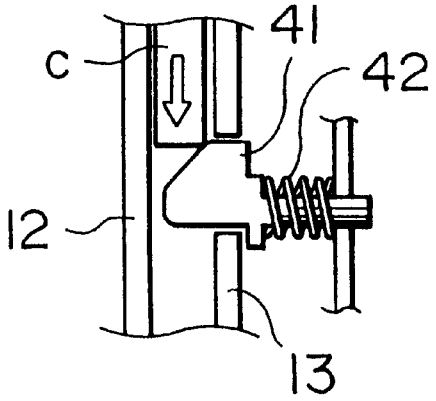
Figure 16C:
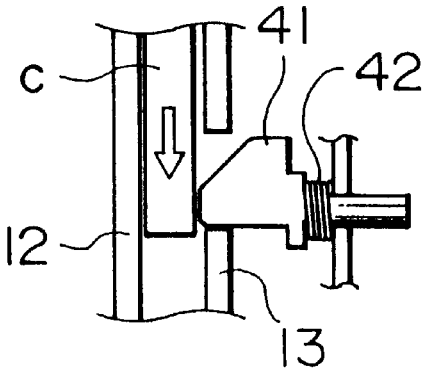

Adjacent the turn plate 14, a pressing member 40 for pressing a coin in the cut-out portion 14*a* of the turn plate 14 against the rear surface of the middle plate 12, in the course of rotation of the turn plate 14, is provided, as shown in FIG. 5. The pressing member 40 comprises a presser 41 and a coil spring 42 for exerting a force to the presser 41, as shown in FIGS. 5 and 16. The tip of the presser 41 has an inclined surface in the upper side thereof. When a coin C passes through near the tip of the presser 41, the coin presses the inclined surface of the presser 41 downwardly to move the presser 41 back in force against the given force by the coil spring 42, as shown in FIGS. 16A–16C. As a result, the coin C is pressed against the rear surface of the middle plate 12.

Further, in this embodiment, it only one capsule commodity is discharged for one operation of the handle 5. Specifically, as shown in FIGS. 5–10, a plurality of engaging pawls 14*c* are provided on the outer circumference of the turn plate 14, while in the vicinity of the turn plate 14 in the figures is provided a reverse-rotation preventing lever 32 which rocks right and left about a shaft 31. The reverse-rotation preventing lever 32 is biased toward the turn plate 14 by means of a ring-shaped resilient member 33 of silicone rubber. Once the engaging pawl 14*b* of the turn plate 14 exceeds the reverse-rotation preventing lever 32, the reverse rotation of the turn plate 14 is prevented by engagement of the reverse-rotation preventing lever 32 with the engaging pawl 14*c* of the turn plate 14, as shown in FIG. 9, even by turning the handle 5 in the reverse direction.

Figure 17:
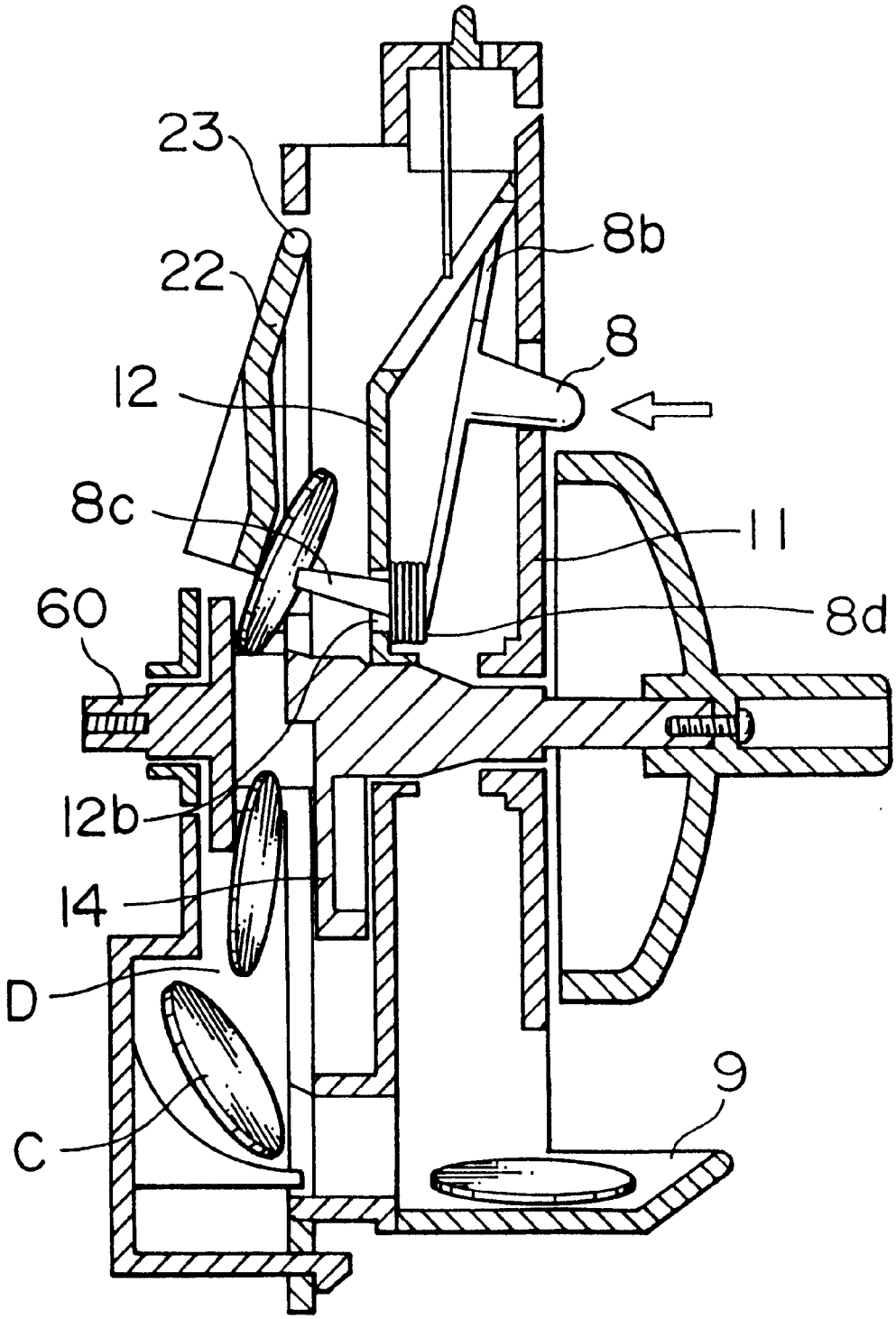
FIG. 17 is a view for explaining a state of the coin discriminating device of the embodiment when a coin return button in the device has been pushed.

Further, in this embodiment, an arrangement is provided for returning a wrongly put-in normal coin and the like. Specifically, as shown in FIGS. 4 and 17, the return button 8 is attached to a swinging plate 8*b* which can swing around a shaft 8*a*. The swinging plate 8*b* is provided to the rear surface of the outer frame 11. On the rear surface of the swinging plate 8*b*, a rod-shaped projection 8*c* is attached. When the swinging plate 8*b* swings, the rod-shaped projection 8*c* can project into the cut-out portion 14*a* of the turn plate 14 which is at the initial position, through a hole 12*b* formed in the middle plate 12. A spring 8*d* is wound around the rod-shaped projection 8*c* to bias the swinging plate 8*b* toward the outer frame 11. Accordingly, the rod-shaped projection 8*c* is generally out of the cut-out portion 14*a* of the turn plate 14.

When the return button 8 is pressed, the rod-shaped projection 8*c* projects into the cut-out portion 14*a* of the turn plate 14 to push a coin C. By this operation, the regulating member 22 is also swung around the shaft 23. As a result, the coin C in the cut-out portion 14*a* is dropped down on a passage D to lead to the return port, through the space between the turn plate 14 and a shaft member 60 arranged in the rear side of the turn plate 14, as shown in FIG. 17.

Figure 18:
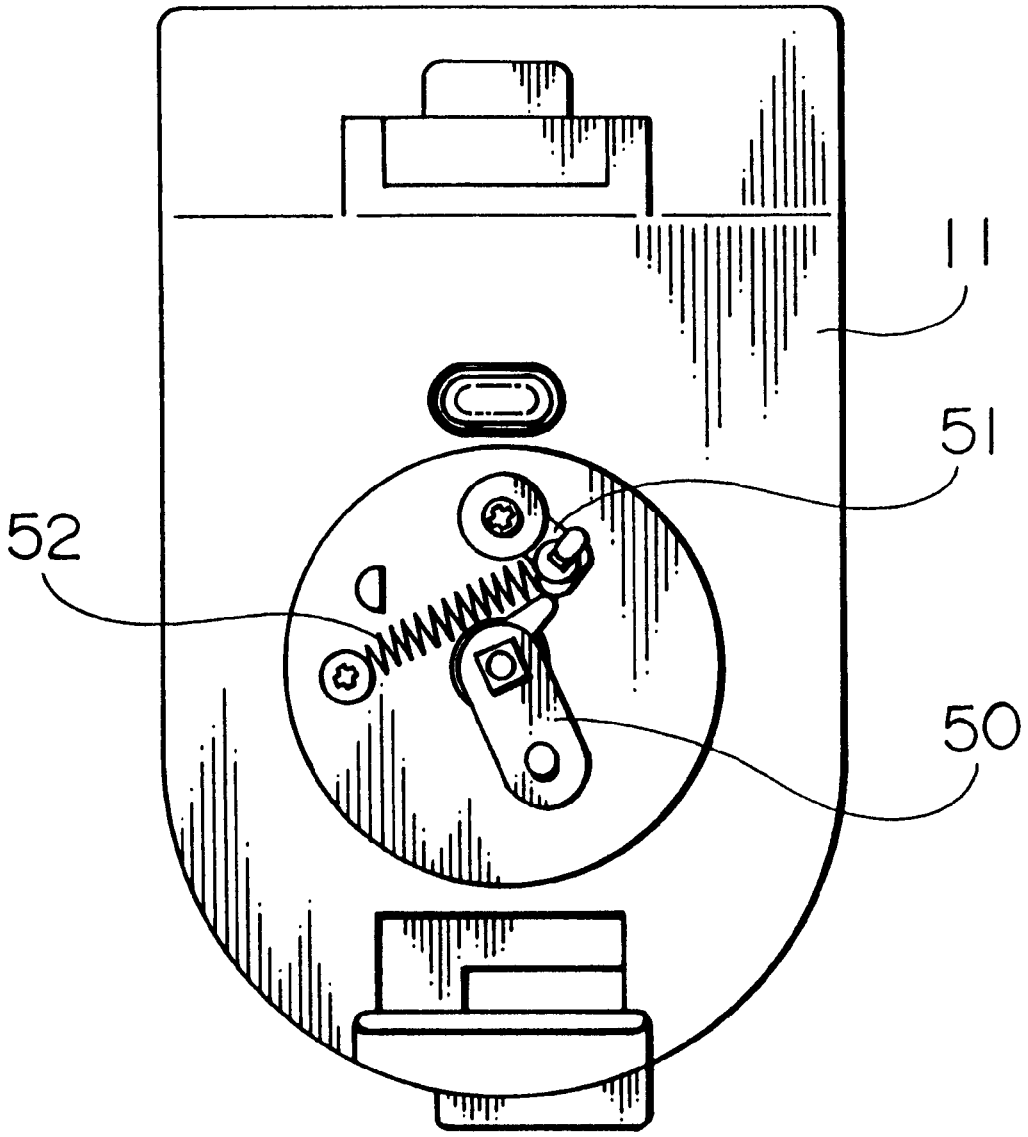
FIG. 18 is a view showing a handle return mechanism in the coin discriminating device of the embodiment.

Further, in this embodiment, a handle return mechanism for returning the handle 5 to the initial position is provided. The handle return mechanism comprises a rotary member 50 which rotates together with the rotation of the handle 5 while engaging a groove 5*a* formed in the rear surface of the handle 5 shown in FIG. 4, a rotatable spring holder 51 provided on the front surface of the outer frame 11, and a coil spring 52 the ends of which are attached to the rotatable spring holder 51 and a fixed portion of the outer frame 11, respectively, as shown in FIG. 18.

Figure 19A:
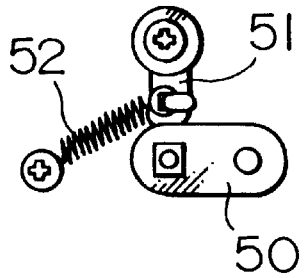
FIGS. 19A to 19C are views for explaining the function of the handle return mechanism in the coin discriminating device of the embodiment.
Figure 19B:
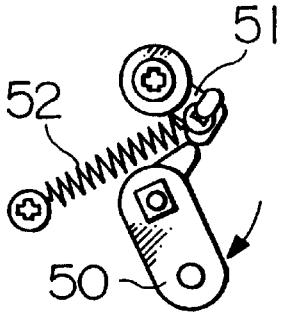
Figure 19C:
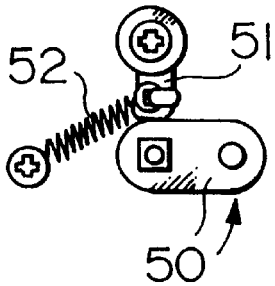
Figure 20:
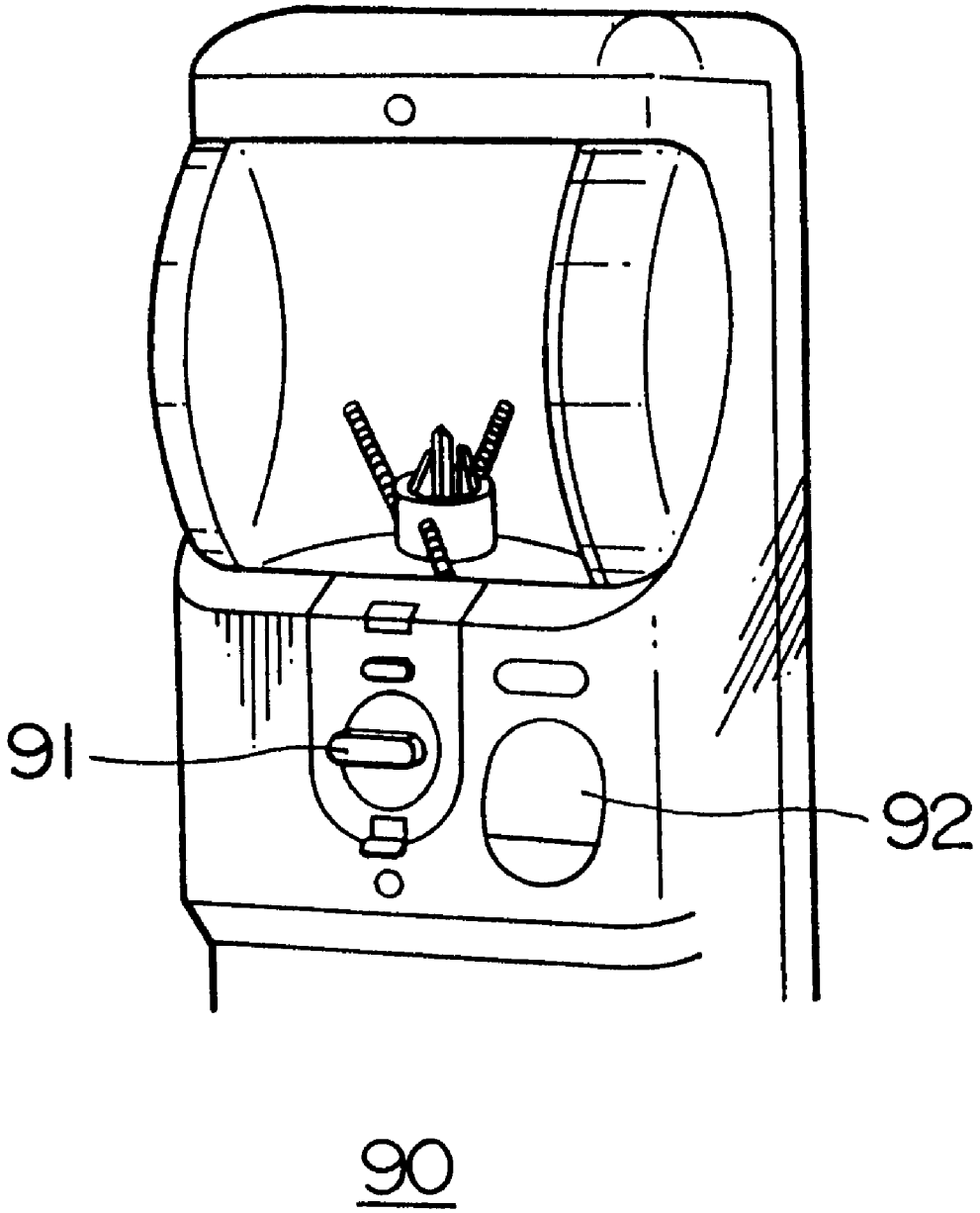
FIG. 20 (Prior Art)
FIG. 20 is a perspective view of an automatic vending machine according to an earlier development.
Figure 21:
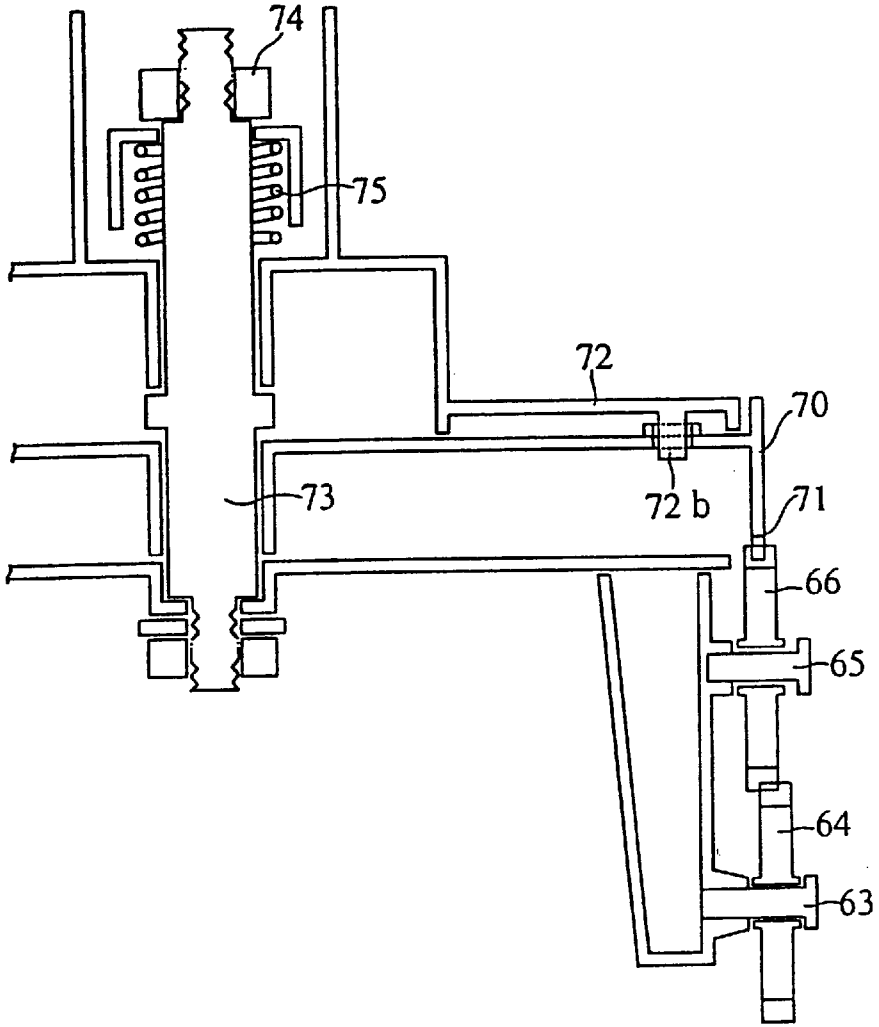
FIGS. 21–25 correspond to FIGS. 16–20 of U.S. Pat. No. 5,715,925.
Figure 22:
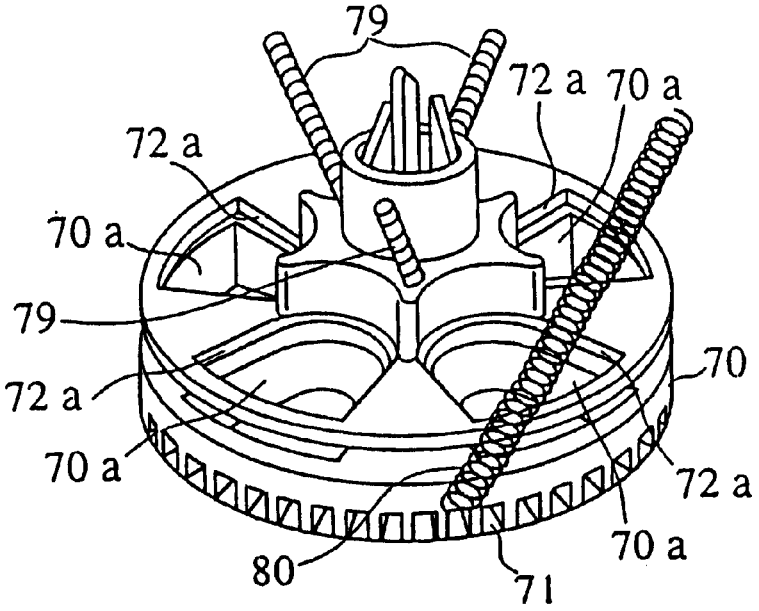
Figure 23:
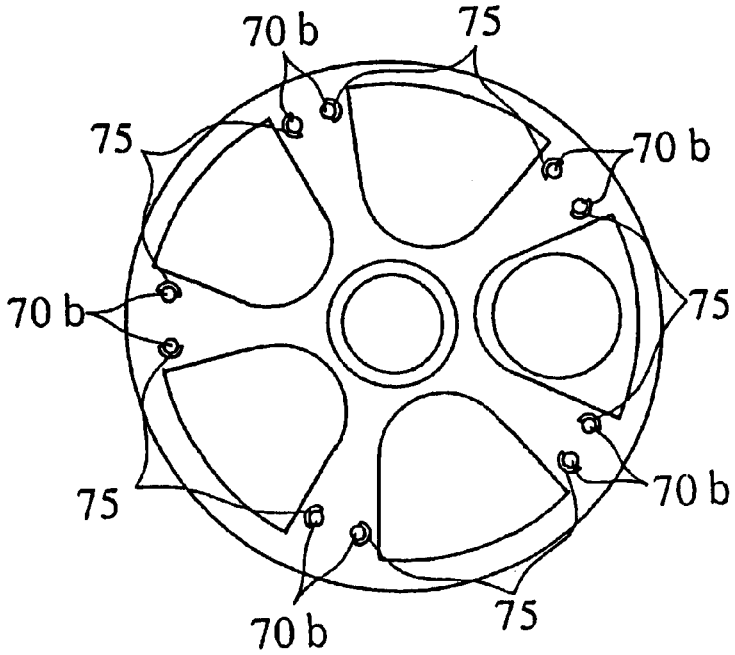
Figure 24:
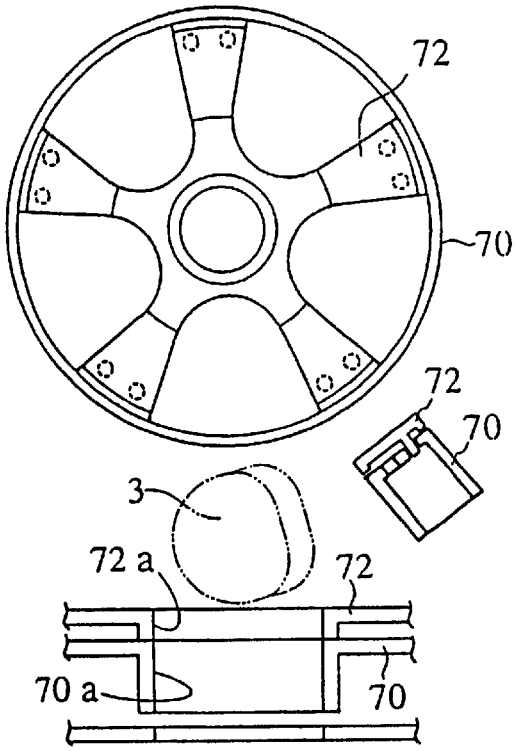
Figure 25:
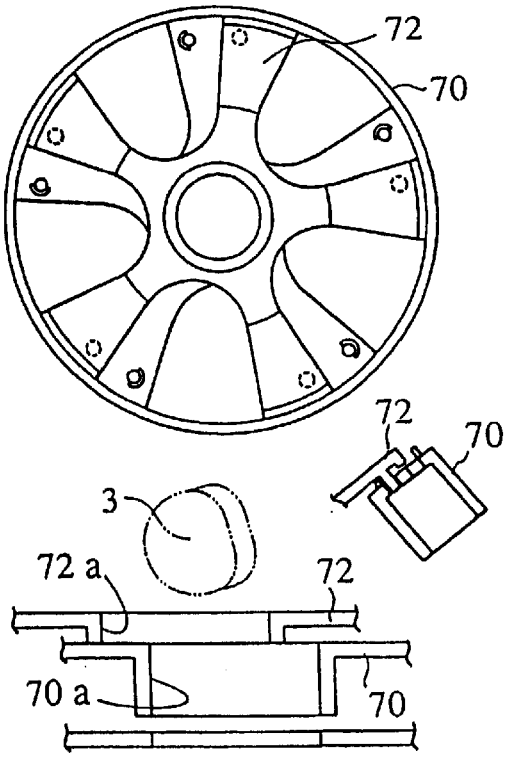

The initial position of the rotatable spring holder 51 is shown in FIG. 19A. When rotating the handle 5, a tip of the rotary member 50 pushes to rotate the rotatable spring holder 51 to some extent, as shown in FIG. 19B. From this state, when the handle 5 is released or turned back a little, the rotary member 50 and the handle 5 are turned back to the respective initial positions by the force stored in the coil spring 52, as shown in FIG. 19C.

In this embodiment, a gear 62 which is integrally rotatable with the handle 5 is provided on the rear surface of the inner frame 13, as shown in FIGS. 2 and 5. The gear 62 engages with a ring-shaped gear (not shown) of a commodity discharging device 60 which is shown in FIG. 2. As a result, the ring-shaped gear and the commodity discharging device 60 are rotated to discharge a capsule commodity 3 through a predetermined hole. As the commodity discharging device 60, it is possible to use the one disclosed in U.S. Pat. No. 5,715,925 which is made by the inventor, or a version thereof. FIGS. 21–25 correspond to FIGS. 16–20 from the noted '925 patent and show a suitable opening regulating member as described therein.

According to the coin discriminating device having such a structure, it is possible to obtain the following advantageous effects.

According to the coin discriminating device 10 of the invention, because a clearing member for clearing the engaging portion of an unnecessary coin discriminating lever out of the region to engage with the coin discriminating pawl portion of the turn plate is used to change the number of normal coins which can be put-in, it is possible to change the number of normal coins to be put-in effectively and to simplify the mechanism.

According to the coin discriminating device having a structure in which the regulating member and the unnecessary coin discriminating lever are worked by using the first and second cams, it is possible to make the structure simple. In the coin discriminating device, when operating only the setting member, the regulating member goes in or out of the cut-out portion of the turn plate which is at an initial position thereof, by a predetermined depth corresponding to the number of normal coins set by the setting member to regulate the number of normal coins which can be put in the cut-out portion, while an unnecessary coin discriminating lever is operated to clear the engaging portion thereof out of the region to engage with the coin discriminating pawl portion of the turn plate. Therefore, because only operation of the setting member works on both the regulating member and the unnecessary coin discriminating lever, it is possible to change the number of normal coins to be put-in easily.

According to the automatic vending machine of the embodiment, because only operation of the setting member works on both the regulating member and the unnecessary coin discriminating lever, it is possible to easily change the number of normal coins to be put-in and to simplify the structure.

The coin discriminating device 10 is easy to handle because the setting member 25 for setting the number of coins to be put-in is used.

In the foregoing, explanation has been made to the embodiment achieved by the present inventors. However, it is needless to say that the present invention is not limited to such an embodiment, but various modifications can be made in a range not changing the gist thereof.

For example, in the foregoing embodiment, explanation has been made to the case where some coins are used. However, game coins can be also used.

The entire disclosure of Japanese Patent Application No. Tokugan hei-10-243817 filed on Aug. 28, 1998 including specification, claims, drawings and summary are incorporated herein by reference in its entirety.

What is claimed is:

1. A coin discriminating device for discriminating put-in coins between a normal coin and a coin smaller than the normal coin, comprising:

a turn plate having a cut-out portion which can receive a plurality of put-in coins and having a coin discriminating pawl portion on a periphery thereof;

a plurality of coin discriminating levers each of which has an engaging portion engageable with the coin discriminating pawl portion of the turn plate and which are provided near the turn plate and are swingable around an axis independently of one another, for abutting against the corresponding received put-in coins in the cut-out portion, respectively, so that when a coin smaller than the normal coin is placed in the cut-out portion, the engaging portion of the coin discriminating lever engages the coin discriminating pawl portion of the turn plate by rotation thereof to prevent the rotation of the turn plate, and when a normal coin is placed in the cut-out portion, the coin discriminating lever is pushed by the normal coin in the cut-out portion to clear the engaging portion of the coin discriminating lever from engagement with the coin discriminating pawl portion of the turn plate;

a biasing member for biasing a free end of each coin discriminating lever to a side of the turn plate;

a handle for rotating the turn plate;

a regulating member for regulating a number of normal coins to be put-in the cut-out portion of the turn plate by going in or out of the cut-out portion;

a setting member for setting the number of normal coins to be put-in to make the regulating member go in or out of the cut-out portion by a predetermined depth corresponding to the number of normal coins set by the setting member; and a clearing member for clearing the engaging portion of an unnecessary coin discriminating lever out of a region to engage with the coin discriminating pawl portion of the turn plate.

2. A coin discriminating device as claimed in claim 1, wherein the setting member is coupled with the clearing member such that setting the number of normal coins to be put-in correspondingly positions the clearing member.

3. A coin discriminating device as claimed in claim 1, wherein the regulating member is adjusted by operating the setting member through a first cam.

4. A coin discriminating device as claimed in claim 1, wherein the unnecessary coin discriminating lever is cleared by operating the clearing member through a second cam.

5. A coin discriminating device as claimed in claim 2, wherein the setting member comprises a first cam for adjusting a depth of the regulating member going in the cut-out portion, and wherein the clearing member comprises a second cam for clearing the unnecessary coin discriminating lever out of the region to engage with the coin discriminating pawl portion of the turn plate.

6. A coin discriminating device as claimed in claim 3, wherein the first cam comprises first and second pressing steps which are formed on a surface of the first cam circumferentially, the first and second pressing steps keeping the regulating member at positions of first and second stages different from each other, with respect to the cut-out portion, respectively.

7. A coin discriminating device as claimed in claim 6, wherein the first cam further comprises a third pressing step which is formed on a surface of the first cam circumferentially, the third pressing step pressing to keep the regulating member at a position of third stage different from those of the first and second pressing surfaces, with respect to cut-out portion.

8. A coin discriminating device as claimed in claim 4, wherein the second cam comprises a first peripheral surface cam for clearing the engaging portion of one of the coin discriminating levers out of the region to engage with the coin discriminating pawl portion of the turn plate.

9. A coin discriminating device as claimed in claim 8, wherein the second cam further comprises a second peripheral surface cam for clearing the engaging portions of two of the coin discriminating levers out of the region to engage with the coin discriminating pawl portion of the turn plate.

10. A coin discriminating device as claimed in claim 1, wherein the clearing member is coaxially connected to the setting member so that rotation of one of the clearing member and the setting member brings rotation of the other member.

11. A coin discriminating device as claimed in claim 10, wherein the setting member comprises a first cam for adjusting a depth of the regulating member going in the cut-out portion, and the clearing member comprises a second cam for clearing the unnecessary coin discriminating lever out of the region to engage with the coin discriminating pawl portion of the turn plate.

12. An automatic vending machine comprising:

a coin discriminating device for discriminating put-in coins between a normal coin and a coin smaller than the normal coin, comprising:

a turn plate having a cut-out portion which can receive a plurality of put-in coins and having a coin discriminating pawl portion on a periphery thereof, a plurality of coin discriminating levers, each of which has an engaging portion engageable with the coin discriminating pawl portion of the turn plate and which are provided near the turn plate and are swingable around an axis independently of one another, for abutting against the corresponding received put-in coins in the cut-out portion, respectively, so that when a coin smaller than the normal coin is placed in the cut-out portion, the engaging portion of the coin discriminating lever engages the coin discriminating pawl portion of the turn plate by rotation thereof to prevent the rotation of the turn plate, and when a normal coin is placed in the cut-out portion, the coin discriminating lever is pushed by the normal coin in the cut-out portion to clear the engaging portion of the coin discriminating lever from engagement with the coin discriminating pawl portion of the turn plate, a biasing member for biasing a free end of each coin discriminating lever to a side of the turn plate, a handle for rotating the turn plate, a regulating member for regulating a number of normal coins to be put in the cut-out portion of the turn plate by going in or out of the cut-out portion, a setting member for setting the number of normal coins to be put in the cut-out portion to make the regulating member go in or out of the cut-out portion by a predetermined depth corresponding to the number of normal coins set by the setting member, and a clearing member for clearing the engaging portion of an unnecessary coin discriminating lever out of a region to engage with the coin discriminating pawl portion of the turn plate; and a commodity discharging device comprising a drum rotatable with respect to a shaft extending in a vertical direction and which is provided with a commodity discharging opening penetrating in a vertical direction and is arranged to discharge a commodity through the commodity discharging opening by rotating the drum through a predetermined angle.

13. An automatic vending machine as claimed in claim 12 further comprising an opening regulating member provided on the drum, which can change effective opening areas of the commmodity discharging opening by overlapping the commodity discharging opening due to rotation thereof.

14. An automatic vending machine as claimed in claim 12, wherein the clearing member is coaxially connected to the setting member so that rotation of one of the clearing member and the setting member brings rotation of the other member.

15. An automatic vending machine as claimed in claim 12, wherein the regulating member is adjusted by operating the setting member through a first cam.

16. An automatic vending machine as claimed in claim 12, wherein the unnecessary coin discriminating lever is cleared by operating the clearing member through a second cam.

17. An automatic vending machine as claimed in claim 14, wherein the setting member comprises a first cam for adjusting a depth of the regulating member going in the cut-out portion, and wherein the clearing member comprises a second cam for clearing the unnecessary coin discriminating lever out of the region to engage with the coin discriminating pawl portion of the turn plate.

18. An automatic vending machine as claimed in claim 15, wherein the first cam comprises first and second pressing steps which are formed on a surface of the first cam circumferentially, the first and second pressing steps keeping the regulating member at positions of first and second stages different from each other, with respect to the cut-out portion, respectively.

19. An automatic vending machine as claimed in claim 16, wherein the second cam comprises a first peripheral surface cam for clearing the engaging portion of one of the coin discriminating levers out of the region to engage with the coin discriminating pawl portion of the turn plate.

20. An automatic vending machine as claimed in claim 19, wherein the second cam further comprises a second peripheral surface cam for clearing the engaging portions of two of the coin discriminating levers out of the region to engage with the coin discriminating pawl portion of the turn plate.

21. A coin discriminating device for discriminating put-in coins between a normal coin and a coin smaller than the normal coin, comprising:

a turn plate having a cut-out portion that is shaped to receive a plurality of put-in coins and having a coin discriminating pawl portion on a periphery thereof;

a plurality of coin discriminating levers disposed in a path of the coin discriminating pawl portion of the turn plate, wherein a size of the normal coin serves to clear the respective coin discriminating levers during rotation of the turn plate;

a biasing member engaging the coin discriminating levers, the biasing member biasing the coin discriminating levers toward engagement with the coin discriminating pawl;

a regulating member disposed in the cut-out portion of the turn plate; and a setting member coupled with the regulating member, the setting member setting a position of the regulating member in the cut-out portion of the turn plate.

22. A coin discriminating device as claimed in claim 21, further comprising a clearing member positioned in a vicinity of the coin discriminating levers, the clearing member being selectively engageable with ones of the coin discriminating levers.

23. A coin discriminating device as claimed in claim 22, wherein the setting member is coupled with the clearing member.

* * * * *